US007672604B2

(12) United States Patent
Takahashi et al.

(10) Patent No.: US 7,672,604 B2
(45) Date of Patent: Mar. 2, 2010

(54) IMAGE FORMING APPARATUS AND IMAGE FORMING METHOD USING ELECTROSTATIC TRANSPORT AND HOPPING

(75) Inventors: Tomoko Takahashi, Yokohama (JP); Masanori Horike, Yokohama (JP); Katsuo Sakai, Yokohama (JP); Yohichiroh Miyaguchi, Yokohama (JP); Nobuaki Kondoh, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 739 days.

(21) Appl. No.: 11/376,434

(22) Filed: Mar. 16, 2006

(65) Prior Publication Data

US 2006/0251449 A1 Nov. 9, 2006

(30) Foreign Application Priority Data

Mar. 16, 2005 (JP) ..... 2005-074178
Mar. 16, 2005 (JP) ..... 2005-074258
Mar. 16, 2005 (JP) ..... 2005-074289

(51) Int. Cl.
*G03G 15/08* (2006.01)

(52) U.S. Cl. ..... 399/55; 399/56; 399/223; 399/289

(58) Field of Classification Search ..... 399/289, 399/40, 55, 56, 223, 285, 270, 266, 290, 399/291
See application file for complete search history.

(56) References Cited

U.S. PATENT DOCUMENTS 4,281,051 A 7/1981 Sakai
4,335,194 A 6/1982 Sakai
4,384,033 A 5/1983 Sakai
4,407,917 A 10/1983 Sakai
4,521,502 A 6/1985 Sakai et al.
4,544,935 A 10/1985 Sakai
4,558,941 A * 12/1985 Nosaki et al. ..... 399/266
4,598,991 A * 7/1986 Hosoya et al. ..... 399/266
4,615,607 A 10/1986 Yanagawa et al.

(Continued)

FOREIGN PATENT DOCUMENTS

JP 02077767 A * 3/1990

(Continued)

OTHER PUBLICATIONS

U.S. Appl. No. 11/546,251, filed Oct. 12, 2006, Tsukamoto, et al.

(Continued)

*Primary Examiner*—Robert Beatty
(74) *Attorney, Agent, or Firm*—Oblon, Spivak, McClelland, Maier & Neustadt, L.L.P.

(57) ABSTRACT

An image forming apparatus having a developing apparatus using a development system in which toner is moved by means of a traveling wave electric field. The image forming apparatus comprises a plurality of developing apparatuses having toner conveyance members which convey toner by means of a phase-shift electric field created by voltages of n phases applied to a plurality of electrodes, to a region opposing an image carrier on which an electrostatic latent image is formed; and a voltage application device which applies a voltage having an average potential value between the potential of the image portions of the latent image on the image carrier and the non-image portions of same, to the electrodes of the toner conveyance members of the respective developing apparatuses.

39 Claims, 21 Drawing Sheets

U.S. PATENT DOCUMENTS

| | | | | |
|---|---|---|---|---|
| 4,655,579 | A | 4/1987 | Adachi et al. | |
| 4,664,501 | A | 5/1987 | Koizumi et al. | |
| 4,690,541 | A | 9/1987 | Sakai et al. | |
| 4,933,727 | A | 6/1990 | Mizuma et al. | |
| 5,051,760 | A | 9/1991 | Shoji et al. | |
| 5,121,170 | A | 6/1992 | Bannai et al. | |
| 5,204,716 | A | 4/1993 | Kasahara et al. | |
| 5,337,075 | A | 8/1994 | Takahashi et al. | |
| 5,504,563 | A * | 4/1996 | Hays | 399/284 |
| 5,955,228 | A | 9/1999 | Sakai et al. | |
| 6,219,515 | B1 * | 4/2001 | Lestrange | 399/289 |
| 6,597,884 | B2 | 7/2003 | Miyaguchi et al. | |
| 6,597,887 | B2 | 7/2003 | Sakai et al. | |
| 6,708,014 | B2 | 3/2004 | Miyaguchi et al. | |
| 6,721,534 | B2 | 4/2004 | Takahashi | |
| 6,901,231 | B1 | 5/2005 | Sakai et al. | |
| 6,941,098 | B2 | 9/2005 | Miyaguchi et al. | |
| 6,947,682 | B2 | 9/2005 | Kosugi et al. | |
| 6,947,691 | B2 | 9/2005 | Miyaguchi et al. | |
| 7,236,720 | B2 * | 6/2007 | Nakazato et al. | 399/111 |
| 2004/0105710 | A1 | 6/2004 | Shakuto et al. | |
| 2004/0126148 | A1 | 7/2004 | Iwai et al. | |
| 2004/0197122 | A1 | 10/2004 | Nakano et al. | |
| 2004/0240907 | A1 | 12/2004 | Miyaguchi et al. | |
| 2004/0265024 | A1 | 12/2004 | Naruse et al. | |
| 2005/0025525 | A1 | 2/2005 | Horike et al. | |
| 2005/0152717 | A1 | 7/2005 | Miyaguchi et al. | |
| 2005/0154562 | A1 | 7/2005 | Matsuura et al. | |
| 2005/0157327 | A1 | 7/2005 | Shoji et al. | |
| 2005/0158073 | A1 | 7/2005 | Nakazato et al. | |
| 2005/0169660 | A1 | 8/2005 | Yamada et al. | |
| 2005/0175377 | A1 | 8/2005 | Sakai et al. | |

FOREIGN PATENT DOCUMENTS

| | | | |
|---|---|---|---|
| JP | 3-21967 | | 1/1991 |
| JP | 5-31147 | | 5/1993 |
| JP | 06110309 | A * | 4/1994 |
| JP | 8-3673 | | 1/1996 |
| JP | 08286477 | A * | 11/1996 |
| JP | 9-329947 | | 12/1997 |
| JP | 2002-6578 | | 1/2002 |
| JP | 2002-258601 | | 9/2002 |
| JP | 3376199 | | 11/2002 |
| JP | 2003005524 | A * | 1/2003 |
| JP | 2004-198744 | | 7/2004 |

OTHER PUBLICATIONS

U.S. Appl. No. 12/261,302, filed Oct. 30, 2008, Kosugi, et al.
U.S. Appl. No. 11/681,940, filed Mar. 5, 2007, Takahashi, et al.
U.S. Appl. No. 12/121,122, filed May 15, 2008, Kadota et al.
U.S. Appl. No. 12/140,032, filed Jun. 16, 2008, Ishii, et al.
U.S. Appl. No. 12/170,930, filed Jul. 10, 2008, Takahashi, et al.
U.S. Appl. No. 12/176,054, filed Jul. 18, 2008, Kadota, et al.
U.S. Appl. No. 12/187,826, filed Aug. 7, 2008, Horike, et al.

* cited by examiner

FIG. 4
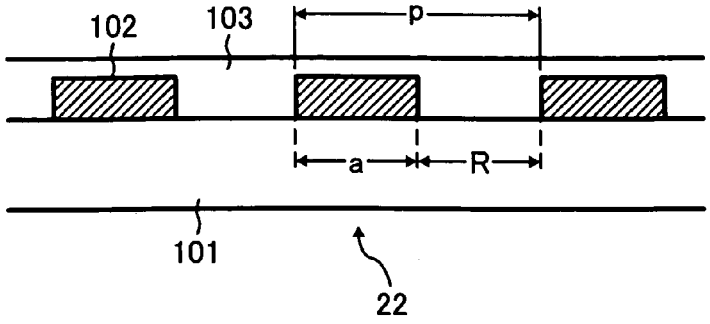
FIG. 5
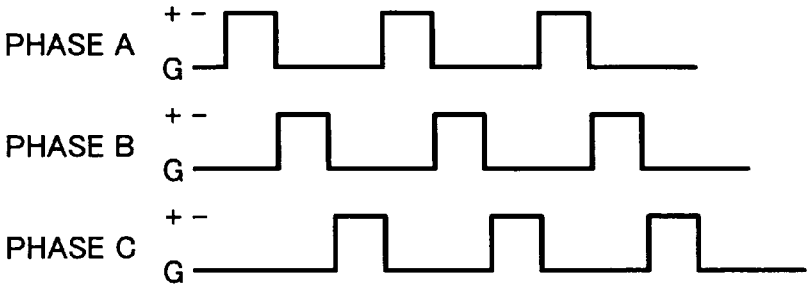
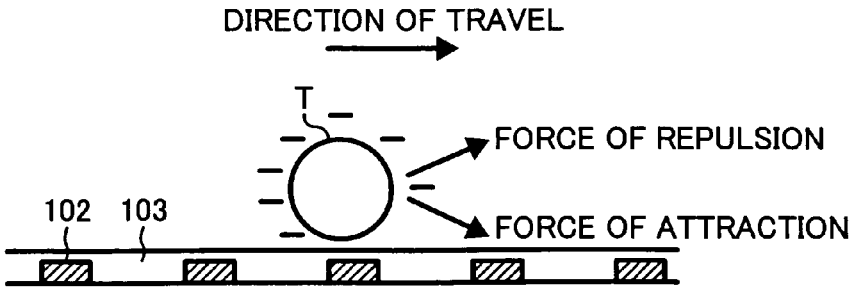
FIG. 6A
| | | | | |
|---|---|---|---|---|
| G | G | + | G | G |
FIG. 6B
| | | | | |
|---|---|---|---|---|
| + | G | G | + | G |
FIG. 6C
| | | | | |
|---|---|---|---|---|
| G | + | G | G | + |

FIG. 23
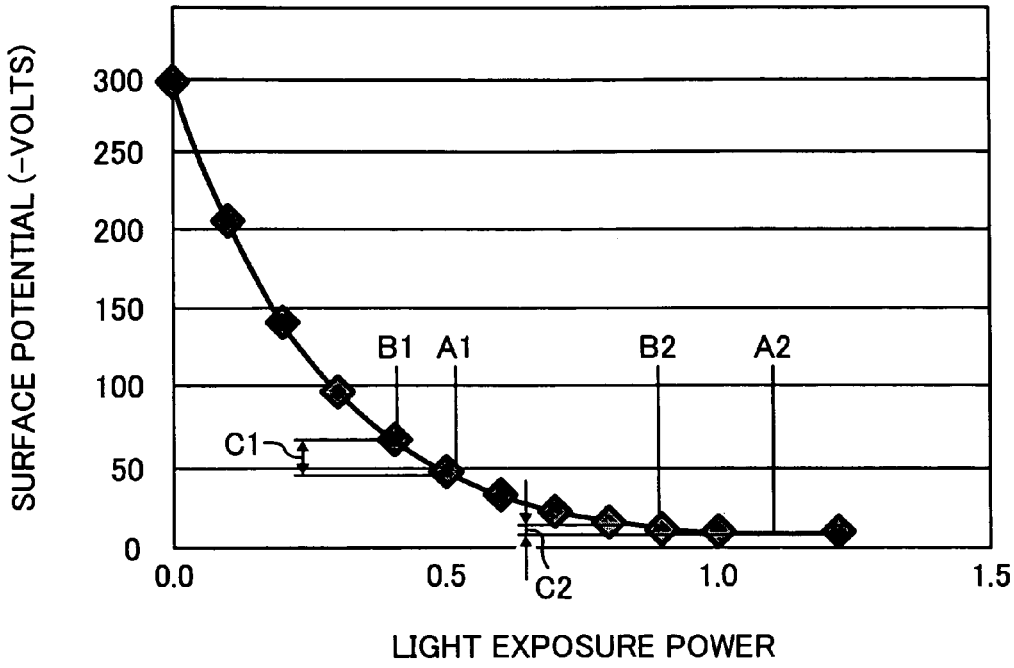
FIG. 24
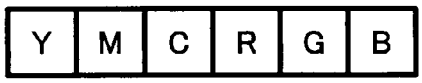
FIG. 25
| | CHARGING POTENTIAL | POTENTIAL AFTER LIGHT EXPOSURE IN MONOCHROME SECTION | AVERAGE VALUE OF DEVELOPING DRIVE VOLTAGE |
|---|---|---|---|
| FIRST COLOR | -140V | -10V | -75V |
| SECOND COLOR | -170V | -15V | -80V |
| THIRD COLOR | -250V | -25V | -90V |

| CONDITIONS | α2 | α3 | CHARGE REMOVAL ? |
|---|---|---|---|
| 1 | 1.0 | 1.0 | NO |
| 2 | 1.3 | 1.7 | NO |
| 3 | 1.2 | 1.4 | YES |

IMAGE FORMING APPARATUS AND IMAGE FORMING METHOD USING ELECTROSTATIC TRANSPORT AND HOPPING

BACKGROUND OF THE INVENTION

1. Field of the Invention

The present invention relates to an image forming apparatus and image forming method, and more particularly, to an image forming apparatus and image forming method comprising a developing apparatus which performs development by transferring a powder by means of a traveling wave electric field.

2. Description of the Related Art

Image forming apparatuses are known, such as printers, facsimile machines, copying machines, plotters, combined printer/fax/copying machines, and the like, which use an electrophotographic process in which an image carrier is charged, a latent electrostatic image is formed thereon, and this electrostatic latent image is developed by depositing powder of a coloring material, or the like, (hereinafter, called "toner" or "toner particle") on the latent image, whereupon the toner image is transferred to a recording medium (such as a transfer material, paper, recording paper, intermediate transfer body, or the like).

An image forming apparatus of this kind is known, as described for example in Japanese Patent Application Publication No. 3530124 (hereinafter, called "PRIOR ART 1"), in which a developer conveyance device is provided to convey the developer by creating a traveling wave electric field through applying a multi-phase voltage to a plurality of electrodes arranged at a predetermined interval, and in a developer apparatus having a developer conveyance device of this kind disposed in the developing region opposing the image carrier which carries the electrostatic latent image on the surface thereof, the developer conveyance device comprises a plurality of electrodes arranged in the form of an endless loop, the plurality of electrodes being divided into a plurality of units and a device being provided in order to control the voltage applied to each unit, in such a manner that a multi-phase voltage can be applied to each unit, independently.

Furthermore, Japanese Patent Application Publication No. 2004-198675 (hereinafter, called "PRIOR ART 2") and Japanese Patent Application Publication No. 2002-258601 (hereinafter, called "PRIOR ART 3"), for example, propose a developing apparatus using a developing method which includes horizontal movement (conveyance) and vertical movement (hopping) of powder by means of electrostatic force, an image on the surface of an electrostatic conveyance member being developed by causing powder to jump up with a component of movement in the direction of travel, by means of a transference electric field. This developing apparatus for developing latent images on an image carrier by depositing powder on the image carrier comprises a conveyance member having a plurality of electrodes, disposed facing the image carrier, which generate a traveling wave electric field in order to move the powder. An electric potential of n phases is applied to the electrodes of the conveyance member, thereby forming an electric field in directions which directs the powder toward the image carrier in the image portion of the latent image, but which does not direct the powder toward the image carrier, in the non-image portions.

On the other hand, as described in PRIOR ART 3, an image forming apparatus is also known in which a photosensitive body is positively charges by a corona charger, a negative electrostatic latent image is formed thereon by exposure to light (namely, an electrostatic latent image in which the surface potential of the photosensitive body is reduced in the positions of the image lines that have been exposed to light), a yellow toner image is then formed by developing the latent image in a developing apparatus using a developing roller, whereupon the yellow electrostatic latent image is erased by removing the charge from the photosensitive drum with a de-charging lamp, and the steps of charging, exposure, development and charge removal are repeated in a similar fashion, thereby successively forming toner images of magenta, cyan and black on the photosensitive body. When all of the toner images have been formed in this way, the electrostatic latent image is de-charged optically by means of the de-charging lamp, and the toner images are transferred electrostatically to normal paper, by means of a corona charger. This image forming apparatus is based on a system (known as a color superimposition method, or image-on-image method) in which a corona charge is applied through the toner layer formed on the photosensitive body, thereby charging the photosensitive body, and toner layers of other colors are superimposed on top of the existing toner image. A similar method is described in Japanese Patent Application Publication No. 08-003673 (hereinafter, called "PRIOR ART 4"), for example, which uses a jumping development method as described below.

Other image forming apparatuses are also known, for instance, as described in Japanese Patent Application Publication No. 2002-6578 (hereinafter, called "PRIOR ART 5") and Japanese Patent Application Publication No. 9-197781 (hereinafter, called "PRIOR ART 6"), an apparatus which performs development by means of a method known as "jumping" development, in which a superimposed DC voltage and AC voltage is applied between an image carrier and a development roller, thereby transferring the toner from the development roller to the image carrier by means of a non-contact method, or as described in Japanese Patent Application Publication No. 9-329947 (hereinafter, called "PRIOR ART 7") or Japanese Patent Application Publication No. 5-31146 (hereinafter, called "PRIOR ART 8"), an apparatus which uses an electrostatic conveyance plate, conveys toner to a position opposing the image carrier, and causes the toner to vibrate, float or assume smoke-like behavior, the toner being separated from the conveyance surface by means of a force of attraction generated between the toner and the image carrier and being deposited onto the surface of the image carrier, or as described in Japanese Patent Application Publication No. 5-31147 (hereinafter, called "PRIOR ART 9"), an apparatus which uses an electric field curtain.

Furthermore, with respect to the developing bias of the development apparatus, as described in Japanese Patent Application Publication No. 3-21967 (hereinafter called "PRIOR ART 10"), for example, an image forming apparatus is known in which the peak voltage of the developing bias is changed in accordance with the variation of the electrostatic capacitance C2 between an image carrier and a developer carrier, by introducing a capacitor C1 and a resistor R, connected in parallel to each other, in series to the output side of the bias power supply, and furthermore, a variable capacitor C3 is introduced in parallel with the electrostatic capacitance C2.

In an image forming apparatus based on a color superimposition method (image-on-image method) as described above, if a contact type developing apparatus is used, which moves toner to a region opposing an image carrier by means of a developing roller (developing sleeve) that rotates while carrying a two-component developer comprising a magnetic carrier and toner, as described in PRIOR ART 3 above, then the image is disturbed, for instance, due to the preceding toner image formed on the image carrier being disrupted by the magnetic effects created during subsequent development processes, and hence the image quality declines markedly.

Therefore, in an image forming apparatus of this kind, when using a non-contact type developing apparatus, image disturbance is prevented by setting extremely strict conditions, by which $L4>L3/10$ and $L4>10$ (μm), where the thickness of the photosensitive body is taken to be L4, $500<|Vs|<1000$ (V), where Vs is taken to be the surface potential of the photosensitive body, $10<L1<40$ (μm), where L1 is taken to be the thickness of the toner layer A deposited on the photosensitive body, $10<L2<50$ (μm), where L2 is taken to be the thickness of the toner layer B on the toner carrier, $50<L3<150$ (μm), where L3 is taken to be the interval between the toner layers A and B. Furthermore, the direction of movement of the surface of the toner layer A and the surface of the toner layer B are set to be the same direction of travel and their speeds of movement are set to be substantially the same.

However, since a good image can only be obtained when the surface potential of the image carrier, the thickness of the toner layer on the image carrier, the thickness of the toner layer on the developer carrier, the speed of movement of the surfaces of the toner layers, and the like, comply with extremely strict conditions in this way, then there is a problem in that such as apparatus cannot effectively be put into practice.

Furthermore, in the image forming apparatus described in PRIOR ART 4, color superimposition is carried out by using a jumping development method, but since jumping development is not a unidirectional development method, then similarly to a case where the aforementioned contact-type developing apparatus is used, the toners already deposited on the photosensitive body may be disturbed during development of the other colors, and toners of different colors may become mixed into the developing devices during development, thus giving rise to color mixing, and the like. In addition, jumping development generally requires a development potential of the order of 400-600 V, and when developing a plurality of colors, it is difficult to ensure a suitable differential in the development potential, thus leading to a decline in reproducibility.

A current and future issue in image forming apparatuses using an electrophotographic process is how to meet requirements relating to image quality, cost and the environment. In the case of image quality, when forming a color image, there is the issue of how to develop one isolated dot having a diameter of only 30 μm, in the case of a 1200 dpi resolution, and more desirably, how to be able to develop images without leaving any borders. Furthermore, with regards to costs, in the case of a personal laser printer, for instance, it is important to lower the total cost which includes not only the unit cost of the developing unit and developing agent, but also the costs of maintenance and final disposal. Moreover, in terms of the environment, it is particularly important to prevent the scattering of toner, which consists of very fine powder, either inside or outside the apparatus.

From these perspectives, the EH development method proposed previously in PRIOR ART 2, and the like, which uses an EH (Electrostatic transport & Hopping) development technique in which a powder is made to jump, with a movement component in the direction of travel, on the surface of an electrostatic conveyance member, by means of a phase-shift electric field (traveling wave electric field), is a unidirectional development method which does not involve contact with the image carrier and which provides excellent performance in that it is capable of developing, for instance, an isolated dot of only 30 μm diameter in a 1200 dpi image as described above.

Technologies relating to the present invention are also disclosed in, e.g., Japanese Patent Application Publication No. 2004-198744 and Japanese Patent Publication No. 3,376,199.

SUMMARY OF THE INVENTION

The present invention was devised in order to resolve problems relating to an image forming apparatus which forms image by superimposition of colors by means of an electrophotographic process, an object thereof being to provide an image forming apparatus and an image forming method having excellent color reproducibility and capable of forming high-quality images, by using EH development.

In an aspect of the present invention, an image forming apparatus visualizes latent images formed successively on an image carrier by developing the latent images by depositing toners of different colors on same. The image forming apparatus comprises a plurality of developing devices, each comprising a toner conveyance member which conveys the toner to a region opposing the image carrier by means of a conveyance electric field created by applying a multi-phase voltage to a plurality of electrodes arranged at a predetermined interval; and a voltage application device which applies the voltage having an average potential value between the potential of image portions of the latent image and the potential of non-image portions of same, to the electrodes of the toner conveyance members of the developing devices.

In another aspect of the present invention, an image forming apparatus visualizes latent images formed successively on an image carrier by developing the latent images by depositing toners of different colors on same. The image forming apparatus comprises a plurality of developing devices, each comprising a toner conveyance member which conveys the toner to a region opposing the image carrier by means of a conveyance electric field created by applying a multi-phase voltage to a plurality of electrodes arranged at a predetermined interval; and a voltage application device which applies the voltage having an average potential value between the potential of image portions of the latent image, which has been reduced by the charge held by previously developed toner, and the potential of non-image portions of same, to the electrodes of the toner conveyance members of the developing devices performing development of at least the second and subsequent colors.

In another aspect of the present invention, an image forming apparatus visualizes latent images formed successively on an image carrier by developing the latent images by depositing toners of different colors on same. The image forming apparatus comprises a plurality of developing devices, each comprising a toner conveyance member which conveys the toner to a region opposing the image carrier by means of a conveyance electric field created by applying a multi-phase voltage to a plurality of electrodes arranged at a predetermined interval; and a voltage application device which applies the voltage having an average potential value between the potential of image portions on the image carrier, in which the charge of previously developed toner has been increased by charging carried out prior to forming the latent image to be developed by the current developing device, and the potential of non-image portions on same, to the electrodes of the toner conveyance members of the developing devices performing development of at least the second and subsequent colors.

In another aspect of the present invention, an image forming apparatus visualizes latent images formed successively on an image carrier by developing the latent images by depositing toners of different colors on same. The image forming apparatus comprises a plurality of developing devices, each comprising a toner conveyance member which conveys the toner to a region opposing the image carrier by means of a conveyance electric field created by applying a multi-phase voltage to a plurality of electrodes arranged at a predetermined interval; and a voltage application device which applies the voltage having an average potential value between the potential of image portions on the image carrier, which has been reduced by the charge held by the previously developed toner and the increase in the charge of the toner due to charging carried out prior to forming the latent image to be developed by the current developing device, and the potential of non-image portions on same, to the electrodes of the toner conveyance members of the developing devices performing development of at least the second and subsequent colors.

In another aspect of the present invention, an image forming apparatus visualizes latent images formed successively on an image carrier by developing the latent images by depositing toners of different colors on same. The image forming apparatus comprises a plurality of developing devices, each comprising a toner conveyance member which conveys the toner to a region opposing the image carrier by means of a conveyance electric field created by applying a multi-phase voltage to a plurality of electrodes arranged at a predetermined interval; and a voltage application device which applies the voltage having a pulse-shaped waveform, in which the potential in the pulse-shaped waveform at which the toner is repulsed and propelled from the toner conveyance member lies between the potential of the image portions of the latent image on the image carrier and the potential of the non-image portions of same, to the electrodes of the toner conveyance members of the respective developing devices.

In another aspect of the present invention, an image forming apparatus visualizes latent images formed successively on an image carrier by developing the latent images by depositing toners of different colors on same. The image forming apparatus comprises a plurality of developing devices, each comprising a toner conveyance member which conveys the toner to a region opposing the image carrier by means of a conveyance electric field created by applying a multi-phase voltage to a plurality of electrodes arranged at a predetermined interval; and a voltage application device which applies the voltage having a pulse-shaped waveform, in which the potential in the pulse-shaped waveform at which the toner is repulsed and propelled from the toner conveyance member lies between the potential of the image portions of the latent image on the image carrier, which has been reduced by the charge held by the previously developed toner, and the potential of the non-image portions of same, to the electrodes of the toner conveyance members of the developing devices performing development of at least the second and subsequent colors.

In another aspect of the present invention, an image forming apparatus visualizes latent images formed successively on an image carrier by developing the latent images by depositing toners of different colors on same. The image forming apparatus comprises a plurality of developing devices, each comprising a toner conveyance member which conveys the toner to a region opposing the image carrier by means of a conveyance electric field created by applying a multi-phase voltage to a plurality of electrodes arranged at a predetermined interval; and a voltage application device which applies the voltage having a pulse-shaped waveform, in which the potential in the pulse-shaped waveform at which the toner is repulsed and propelled from the toner conveyance member lies between the potential of the image portions on the image carrier, in which the charge of previously developed toner has been increased by charging carried out prior to forming the latent image to be developed by the current developing device, and the potential of non-image portions on same, to the electrodes of the toner conveyance members of the developing devices performing development of at least the second and subsequent colors.

In another aspect of the present invention, an image forming apparatus visualizes latent images formed successively on an image carrier by developing the latent images by depositing toners of different colors on same. The image forming apparatus comprises a plurality of developing devices, each comprising a toner conveyance member which conveys the toner to a region opposing the image carrier by means of a conveyance electric field created by applying a multi-phase voltage to a plurality of electrodes arranged at a predetermined interval; and a voltage application device which applies the voltage having a pulse-shaped waveform, in which the potential in the pulse-shaped waveform at which the toner is repulsed and propelled from the toner conveyance member lies between the potential of image portions on the image carrier, which has been reduced by the charge held by the previously developed toner and the increase in the charge of the toner due to charging carried out prior to forming the latent image to be developed by the current developing device, and the potential of non-image portions on same, to the electrodes of the toner conveyance members of the developing devices performing development of at least the second and subsequent colors.

In another aspect of the present invention, an image forming apparatus comprises one image carrier; a plurality of developing devices which develop successively formed latent images on the image carrier by depositing toners of different colors on same; charging devices which charge the image carrier for the respective colors; toner conveyance members which respectively convey the toner to a region opposing said image carrier by means of a conveyance electric field created by applying a multi-phase voltage to a plurality of electrodes arranged at a predetermined interval; and a voltage application device which applies the voltage having an average potential value between the potential of the image portions of the latent image and the potential of the non-image portions of same, to the electrodes of the toner conveyance members of the developing devices.

In another aspect of the present invention, an image forming apparatus comprises one image carrier; a plurality of developing devices which develop successively formed latent images on the image carrier by depositing toners of different colors on same; charging devices which charge the image carrier for the respective colors; toner conveyance members which respectively convey the toner to a region opposing the image carrier by means of a conveyance electric field created by applying a multi-phase voltage to a plurality of electrodes arranged at a predetermined interval; and a voltage application device which applies the voltage having a pulse-shaped waveform, in which the potential in the pulse-shaped waveform at which the toner is repulsed and propelled from the toner conveyance member lies between the potential of the image portions of the latent image on the image carrier and the potential of the non-image portions of same, to the electrodes of said toner conveyance members of the developing devices.

In another aspect of the present invention, an image forming apparatus comprises one image carrier; a plurality of developing devices which develop successively formed latent images on the image carrier by depositing toners of different colors on same; one charging device which charges the image carrier; toner conveyance members which respectively convey the toner to a region opposing the image carrier by means of a conveyance electric field created by applying a multi-phase voltage to a plurality of electrodes arranged at a predetermined interval; a voltage application device which applies the voltage having an average potential between the potential of the image portions of the latent image and the non-image portions of same, to the electrodes of the toner conveyance members of the developing devices; a plurality of charge removal devices which remove charge from the image carrier, disposed on the upstream side of the developing devices of the second and subsequent colors; and a device which applies a voltage comprising a mutually superimposed DC bias and AC bias, where the polarity of the DC bias is the same as the polarity of the charging for image formation of the next color carried out after charge removal, to the charge removal devices.

In another aspect of the present invention, an image forming apparatus comprises one image carrier; a plurality of developing devices which develop successively formed latent images on the image carrier by depositing toners of different colors on same; one charging device which charges the image carrier; toner conveyance members which respectively convey the toner to a region opposing the image carrier by means of a conveyance electric field created by applying a multi-phase voltage to a plurality of electrodes arranged at a predetermined interval; a voltage application device which applies the voltage having a pulse-shaped waveform in which the potential in the pulse-shaped waveform at which the toner is repulsed and propelled from the toner conveyance member lies between the potential of the image portions of the latent image on the image carrier and the non-image portions of same, to the electrodes of the toner conveyance members of the developing devices; a plurality of charge removal devices which remove charge from the image carrier, disposed on the upstream side of the developing devices of the second and subsequent colors; and a device which applies a voltage comprising a mutually superimposed DC bias and AC bias, where the polarity of the DC bias is the same as the polarity of the charging for image formation of the next color carried out after charge removal, to the charge removal devices.

In another aspect of the present invention, an image forming method forms images by successively superimposing toner images of different colors onto one image carrier, by performing charging, light exposure and development, respectively for each color, during one rotation of said image carrier. The development is performed by applying a multi-phase voltage having a pulse-shaped waveform, in which the potential of the pulse-shaped waveform at which toner is repulsed and propelled from a toner conveyance member lies between the potential of the image portions of the latent image on the image carrier and the potential of the non-image portions of same, to a plurality of electrodes arranged at a predetermined interval, provided in toner conveyance members which respectively convey toner to a region opposing the image carrier by means of a conveyance electric field created by applying the multi-phase voltage to the electrodes.

In aspect of the present invention, an image forming apparatus comprises one image carrier; an exposure device which forms a latent image by performing light exposure successively on the image carrier; a plurality of developing devices which develop the latent images formed on the image carrier by depositing toners of different colors successively on same; and toner conveyance members which respectively convey the toner to a region opposing the image carrier by means of a conveyance electric field created by applying a multi-phase voltage to a plurality of electrodes arranged at a predetermined interval. The voltage having an average potential between the potential of the image portions of the latent image and the potential of the non-image portions of same, is applied to said electrodes. The exposure device comprises a device which varies the light exposure energy during formation of the latent image in such a manner that, when forming a latent image on the image carrier on which toner has already been deposited, the value of $|Vdt-Vdn|$ becomes small, where Vdt is the potential difference between the average potential and the potential of an image portion of the latent image on the image carrier in a region where toner has already been deposited, and Vdn is the potential difference between the average potential and the potential of an image portion of the latent image on the image carrier in a region where toner has not been deposited.

In another aspect of the present invention, an image forming apparatus comprises one image carrier; an exposure device which forms a latent image by performing light exposure successively on the image carrier; a plurality of developing devices which develop the latent images formed on the image carrier by depositing toners of different colors successively on same; and toner conveyance members which respectively convey the toner to a region opposing the image carrier by means of a conveyance electric field created by applying a multi-phase voltage to a plurality of electrodes arranged at a predetermined interval. The voltage having a pulse-shaped waveform in which the potential in the pulse-shaped waveform at which the toner is repulsed and propelled from the toner conveyance member lies between the potential of the image portions of the latent image on the image carrier and the potential of the non-image portions of same, is applied to said electrodes. The exposure device comprises a device which varies the light exposure energy during formation of the latent image in such a manner that, when forming a latent image on the image carrier on which toner has already been deposited, the value of $|Vdt-Vdn|$ becomes small, where Vdt is the potential difference between the potential at which the toner is repulsed and propelled, and the potential of an image portion of the latent image on the image carrier in a region where toner has already been deposited, and Vdn is the potential difference between the potential at which the toner is repulsed and propelled, and the potential of an image portion of the latent image on the image carrier in a region where toner has not been deposited.

BRIEF DESCRIPTION OF THE DRAWINGS

The above and other objects, features and advantages of the present invention will become more apparent from the following detailed description taken with the accompanying drawings, in which

FIG. 4 is a diagram for describing the electrode arrangement of the aforementioned toner conveyance member;

FIG. 5 is a diagram for describing the principles of toner conveyance by means of the aforementioned toner conveyance member;

FIGS. 6A to 6C and FIGS. 7A to 7D are diagrams for describing the principles of the toner conveyance described above;

FIG. 23 is a diagram for describing the relationship between the light exposure power and the surface potential of the image carrier;

FIG. 24 is a diagram for describing an image pattern in respective experimental examples of this second embodiment of the present invention;

FIG. 25 is a diagram for describing the charge removal conditions relating to same;

DESCRIPTION OF THE PREFERRED EMBODIMENTS

Below, embodiments of the present invention are described with reference to the drawings.

1st Embodiment

Figure 1:
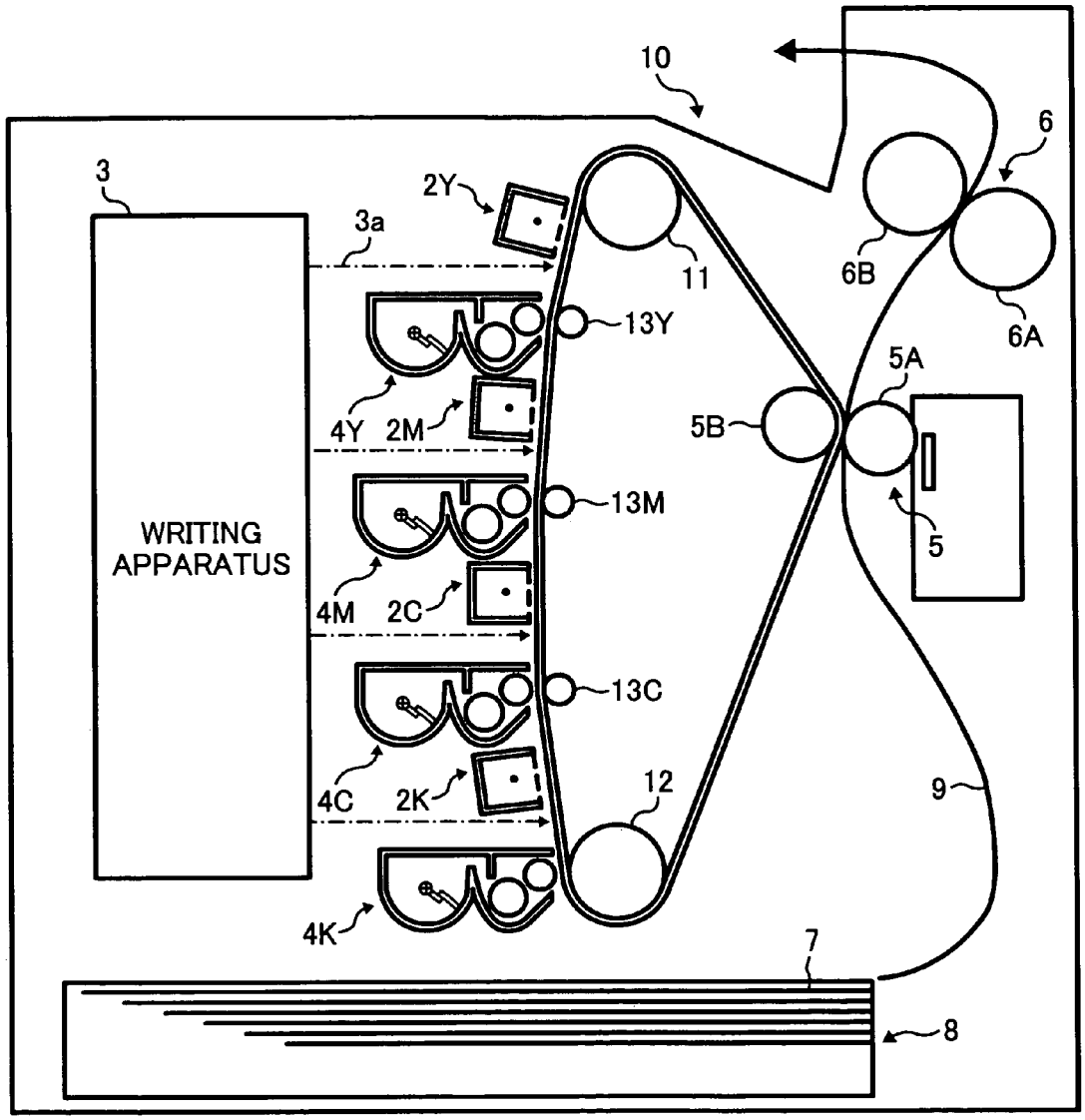
FIG. 1 is a diagram showing the general composition of a first embodiment of an image forming apparatus according to the present invention.

A first embodiment of the image forming apparatus according to the present invention is described here with reference to FIG. 1.

FIG. 1 shows an approximate view of the general composition of the image forming apparatus. This image forming apparatus comprises an image carrier 1 comprising a belt-shaped photosensitive body, and, disposed from the upstream side to the downstream side following the circumferential direction of the image carrier 1 (the direction indicated by the arrow): a charging apparatus 2Y, which uniformly charges the image carrier 1 in order to form a yellow image; a developing apparatus 4Y which develops a latent image formed by a writing apparatus 3 on the image carrier 1, by depositing yellow toner thereon; a charging apparatus 2M, which uniformly charges the image carrier 1 in order to form a magenta image; a developing apparatus 4M which develops a latent image formed by a writing apparatus 3 on the image carrier 1, by depositing magenta toner thereon; a charging apparatus 2C, which uniformly charges the image carrier 1 in order to form a cyan image; a developing apparatus 4C which develops a latent image formed by a writing apparatus 3 on the image carrier 1, by depositing cyan toner thereon; a charging apparatus 2K, which uniformly charges the image carrier 1 in order to form a black image; a developing apparatus 4K which develops a latent image formed by a writing apparatus 3 on the image carrier 1, by depositing black toner thereon; a transfer apparatus 5 which transfers the full-color toner image formed by the mutually superimposed toner images on the image carrier 1; a fixing apparatus 6; a paper supply apparatus 8 for accommodating a transfer material 7; and the like.

Here, the image carrier 1 is wrapped about a conveyance roller 11, an idle roller 12, a transfer facing roller 5B which constitutes the transfer apparatus 5, and opposing rollers 13Y, 13M and 13C which oppose the developing apparatuses 4Y, 4M and 4C, and it is driven in rotation in the direction of the arrow by the rotation of the conveyance roller 11. The charging apparatuses 2Y, 2M, 2C and 2K (hereinafter, referred to generally as "charging apparatus 2" when not to be distinguished in particular; the same applies to other members and devices) uses a scrotron charger, and it creates a uniform negative charge on the surface of the image carrier 1. By using a non-contact charging device as the charging device, it is possible to charge the image carrier without disturbing the toner image formed on the image carrier by the previous image formation step, and hence a good image can be obtained.

The writing apparatus 3 writes a latent image onto the image carrier 1 that has been charged by the charging apparatus 2, in accordance with the image information, and this writing apparatus 3 may be one of various types of writing apparatuses, such as a laser-based light scanning apparatus, an LED array, or the like. The details of the developing apparatuses 4 are described below. The transfer apparatus 5 comprises a transfer roller 5A and a transfer facing roller 5B. The fixing apparatus 6 comprises a heating roller 6A and a pressure roller 6B opposing same.

In this image forming apparatus, when the apparatus is functioning as a copying machine, then image information read in from a scanner (not illustrated) is converted from audio to digital format, and subjected to MTF correction, tonal graduation processing, and other image processes, thereby converting the information into write data. Furthermore, when the apparatus is functioning as a printer, image information in a page script language or a bitmap format, transferred from a computer or the like, is subjected to image processing and converted into write data.

Prior to image formation, the image carrier 1 start a rotational movement in the direction of the arrow in FIG. 1, in such a manner that its surface moves at a prescribed speed. In this, the image carrier 1 is charged uniformly by the charging apparatus 2Y at a prescribed timing, and the writing apparatus 3 performs light exposure by irradiating laser light 3*a* onto the charged image carrier 1 in accordance with the write data for the yellow image. In other words, by irradiating light and changing the potential of the image portions, it creates a differential between these sections and the non-image portions onto which light is not irradiated, thereby forming an electrostatic latent image by means of this contrast of electric potential. Subsequently, yellow toner is deposited on the image portions of the electrostatic latent image formed on the image carrier 1, by the developing apparatus 4Y, thereby forming a yellow toner image on the image carrier 1.

Next, the image carrier 1 is charged uniformly by the charging apparatus 2M, including the region on which the yellow toner image has been formed, and the writing apparatus 3 performs light exposure by irradiating laser light 3*a* onto the charged image carrier 1 in accordance with the write data for the magenta image, thereby forming an electrostatic latent image of the magenta image. Subsequently, magenta toner is deposited onto the image portions of the electrostatic latent image formed on the image carrier 1, by the developing apparatus 4M, thereby forming a toner image on the image carrier 1 in which a magenta toner image is superimposed on the yellow toner image.

Thereafter, in a similar fashion, a toner image is formed on the image carrier 1 by superimposing a cyan toner image on the yellow and magenta toner images, and furthermore, a toner image is then formed on the image carrier 1 by superimposing a black toner on the toner image of the three superimposed colors.

On the other hand, at a prescribed timing, the transfer material 7 is conveyed along a conveyance path 9 from the paper supply apparatus 8, and the toner image of superimposed colors on the image carrier 1 is transferred onto the transfer material 7 by the transfer apparatus 5, and then subjected to fixing by the fixing apparatus 6, whereupon the transfer material 7 on which a full color image has been formed is output to the paper output unit 10.

Figure 2:
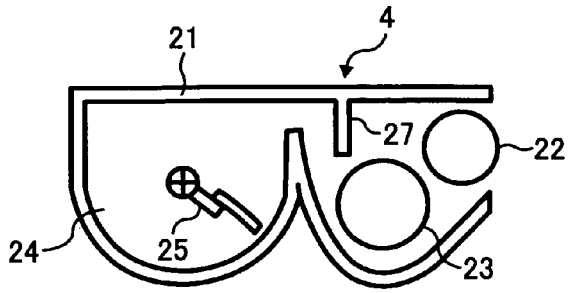
FIG. 2 is a diagram for describing a developing apparatus of the aforementioned image forming apparatus.

Here, the details of the developing apparatuses 4 will be described with reference to FIG. 2.

In these developing apparatuses 4, as shown in the diagram, a developing device is constituted by providing, inside a casing 21, a toner conveyance member 22 formed in a roller shape which conveys toner to a region opposing the image carrier 1 (opposing region), by means of a phase-shift electric field, a developer carrier 23 which faces the toner conveyance member 22 and which is a toner supply device for supplying toner to the toner conveyance member 22, and a developer accommodating unit 24 which accommodates a two-component developer comprising a toner and magnetic carrier, which is supplied by the developer carrier 23, (alternatively, the developer may also be a one-component developer comprising toner only).

Here, the toner conveyance member 22 is disposed so as to oppose the image carrier 1 and the developer carrier 23, in regions which are opposite in the radial direction of the toner conveyance member 22. Furthermore, the toner conveyance member 22 and the image carrier 1 oppose each other without making contact, at an interval of 50-1000 μm, and desirably, 150-400 μm, therebetween. Furthermore, the toner conveyance member 22 does not rotate, but rather, it conveys toner over the outer circumference thereof by means of a conveyance electric field (phase-shift electric field) in the direction of the arrow. On the other hand, the developer carrier 23 does rotate, in the direction indicated by the arrow.

A fixed magnet is provided inside the developer carrier 23, and the developer inside the developer accommodating unit 24 is supplied to the surface of the developer carrier 23 by means of the rotation and magnetic force of the developer carrier 23, and a churning screw 25. Furthermore, a developer layer restricting member 27 is provided so as to oppose the outer circumference of the developer carrier 23, and it limits the developer on the developer carrier 23 to a developer layer of a prescribed thickness. The developer supplied to the developer carrier 23 is conveyed to a region opposing the toner conveyance member 22, due to the rotation of the developer carrier 23.

Here, a supply bias is applied to the developer carrier 23 by a voltage application device (not illustrated). Furthermore, a voltage for forming a conveyance electric field is applied to electrodes of the toner conveyance member 22 by means of a voltage application device (drive circuit), described hereinafter.

Accordingly, an electric field is generated between the toner conveyance member 22 and the developer carrier 23, in the region where the developer carrier 23 and the toner conveyance roller oppose each other. Due to the electrostatic force created by the electric field, the toner is separated from the carrier and moves to the surface of the toner conveyance member 22. Upon reaching the surface of the toner conveyance member 22, the toner is then conveyed (moved) by hopping over the surface of the toner conveyance member 22, due to the conveyance electric field (phase-shift electric field) formed by the voltage applied to the electrodes.

Thereupon, the toner conveyed by this conveyance electric field to a region opposing the image carrier 1 then moves onto the image carrier 1, due to the development electric field between the toner conveyance member 22 and the image portions on the image carrier 1, thereby visualizing the latent image on the image carrier 1 (namely, developing the latent image).

Next, the details of the toner conveyance member 22 which constitutes the developing device will be described with reference to FIG. 3.

As shown in this diagram, the toner conveyance member 22 comprises a plurality of electrodes 102, 102, 102, . . . disposed at a predetermined interval in the toner movement direction on a supporting substrate 101, grouped into sets of n electrodes each. An insulating electrostatic conveyance surface forming member, which forms an electrostatic conveyance surface 103*a*, is created on top of these electrodes, and a surface protection layer 103 made of an organic or inorganic insulating material is layered thereon to form a protective film covering the surface of the electrodes 102.

For the supporting substrate 101, it is possible to use a substrate made of an insulating material, such as a glass substrate, a resin substrate or a ceramic substrate, or alternatively, a substrate made of a conductive material, such as stainless steel, which is then coated with an insulating film, or a substrate made of a flexible and deformable material, such as polyimide film.

The electrodes 102 are formed by creating a film of conductive material, such as Al or Ni—Cr, onto the supporting substrate 101, to a thickness of 0.1-10 μm and desirably 0.5-2.0 μm, and then patterning this film into prescribed electrode shapes by means of a photolithographic technique, or the like. The width (electrode width) a of the plurality of electrodes 102 in the toner conveyance direction is equal to or greater than the average size of the conveyed powder particles, and equal to or less than 20 times this average size. Furthermore, the pitch p between the electrodes 102, 102 is equal to or greater than the average size of the conveyed toner, and equal to or less than 20 times this average size (see FIG. 4).

The surface protection layer 103 is formed by creating a film of $SiO_2$, $TiO_2$, $TiO_4$, SiON, BN, TiN, $Ta_2O_5$, or the like, to a thickness of 0.5-10 μm, and desirably, a thickness of 0.5-3 μm. Furthermore, it is also possible to use an inorganic nitride compound, such as SiN, Bn, W, or the like. An inorganic nitride compound having a small amount of surface hydroxyl group (SiOH, silatol) is preferable, since the amount of charge on the toner tends to decline during conveyance, as the amount of surface hydroxyl group increases.

Figure 3:
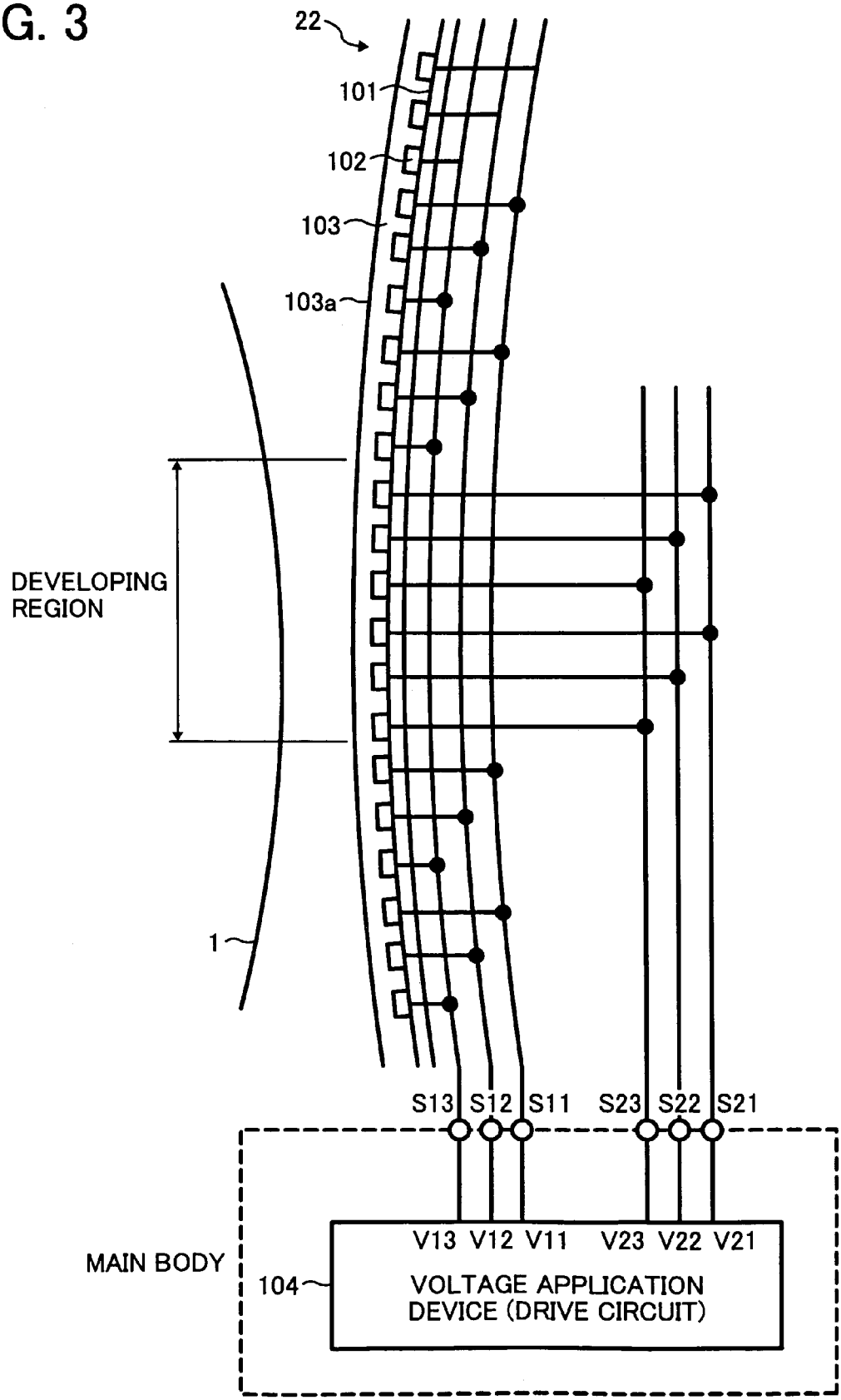
FIG. 3 is a diagram for describing one example of a tone conveyance member according to a first embodiment of the present invention.

In FIG. 3, the lines extending from the respective electrodes 102 represent the lines of electrical conduction for applying the voltage to the respective electrodes 102, and in the overlapping sections of the lines, only the sections indicated by black circles are electrically connected, while the other overlapping sections are in an electrically insulated state. Different drive voltages V11-V13, and V21-V23, of n phases are applied to the electrodes 102 from the voltage application device (drive circuit) 104 on the main body. The present embodiment is described with respect to a case where three-phase drive voltages are applied (n=3), but the present invention may be applied to cases of multiple-phase voltages (n phases) where n is any natural number satisfying n>2, provided that the toner is conveyed.

Furthermore, the electrodes 102 of the toner conveyance member 22 are each connected to contact points S11, S12, S13, S21, S22, S23 on the four sides of the developing apparatus 4, and these contact points S11, S12, S13, S21, S22, S23 are connected to a voltage application device 104 on the main body of the image forming apparatus, which respectively supplies drive waveforms V11, V12, V13, V21, V22, V23, when the developing apparatus 4 is installed in the main body of the image forming apparatus.

The toner conveyance member 22 is divided into: a conveyance region (including a recovery region) in which it moves the toner to the vicinity of the image carrier 1 and recovers toner that has not been used for developing after passing through the developing region; and a developing region for forming a toner image by depositing toner onto the latent image on the image carrier 1.

The developing region only exists in the vicinity of the image carrier 1, while the conveyance region occupies the whole of the circumferential region of the toner conveyance member 22, apart from the developing region. In the present invention, the region where the toner can be moved by means of a phase-shift electric field is called the "electrostatic conveyance surface". In the case of the present embodiment, the whole of the circumferential surface of the toner conveyance member 22 forms an electrostatic conveyance surface.

In the conveyance region, drive waveforms, V11, V12, V13 are applied to the electrodes 102 by the voltage application device 104, and in the developing region, drive waveforms, V21, V22, V23 are applied to the electrodes 102 by the voltage application device 104.

Next, the principles of the electrostatic conveyance of the toner by the toner conveyance member 22 will be described. By applying pulse-shaped voltages of n phases to the plurality of electrodes 102 in the toner conveyance member 22, a phase-shift electric field (traveling wave electric field) is generated by the plurality of electrodes 102, and the charged toner on the toner conveyance member 22 is caused to move in a direction of movement, by receiving a force of repulsion and/or a force of attraction.

For example, as shown in FIG. 5, pulse-shaped drive waveforms (voltages) of three phases, phase A, phase B and phase C, which change between a ground potential G (0V) and a positive voltage +, are applied at staggered timings to the plurality of electrodes 102 in the toner conveyance member 22.

In this case, as shown in FIGS. 6A to 6C, if there is negatively charged toner T on the toner conveyance member 22, and voltages of "G", "G", "+", "G", "G", are applied respectively to a plurality of electrodes 102 situated in consecutive positions in the toner conveyance member 22 (as shown in FIG. 6A), then the negatively charger toner T is displaced to a position over the electrode 102 having a voltage of "+". At the next timing, voltages of "+", "G", "G", "+", "G", are applied respectively to the plurality of electrodes 102 (as shown in FIG. 6B), and a force of repulsion acts between the negatively charged toner T and the electrode 102 having a voltage of "G" on the left-hand side thereof, while a force of attraction acts between the toner T and the electrode 102 having a voltage of "+" on the right-hand side thereof. Consequently, the negatively charger toner T moves toward the electrode 102 having a "+" voltage. Furthermore, at the next timing, as shown in FIG. 6C, voltages of "G", "+", "G", "G" and "+" are applied respectively to the plurality of electrodes 102, and forces of repulsion and attraction act respectively on the negatively charger toner T, in a similar fashion, thereby causing the negatively charged toner T to move again toward the electrode 102 having the "+" voltage.

Figure 7A:
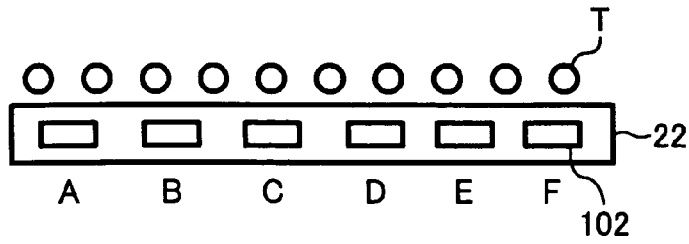
Figure 7B:
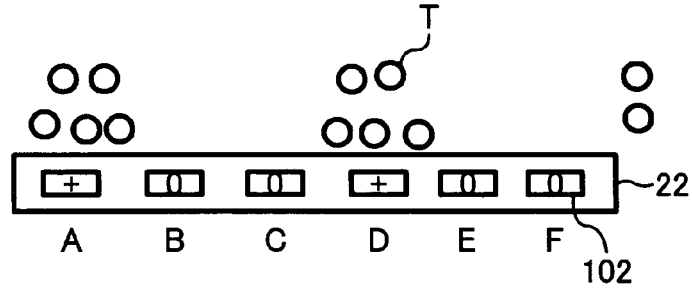
Figure 7C:
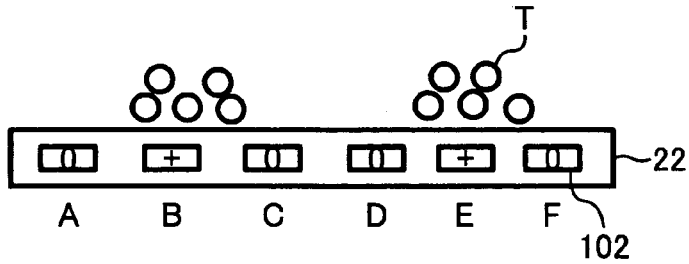
Figure 7D:
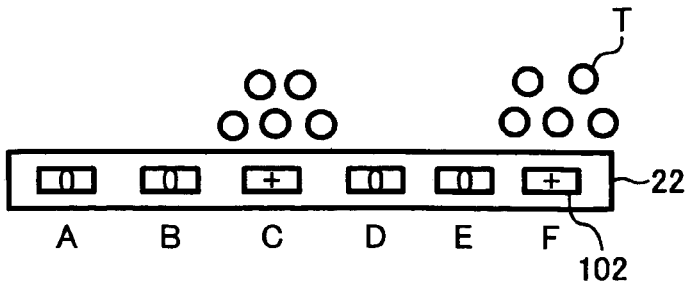

A concrete description of this action is now described with reference to FIGS. 7A to 7D. Starting from a state as shown in FIG. 7A, where 0V (G) is applied to all of the electrodes A-F of the toner conveyance member 22 and the negatively charged toner T is loaded onto the toner conveyance member 22, if a voltage of "+" is then applied to electrodes A and D, as shown in FIG. 7B, the negatively charged toner particles T are attracted to the electrode A and electrode D, and therefore move to positions over these electrodes A and D. At the next timing, if both electrodes A and D assume a voltage of "0", while a voltage of "+" is applied to electrodes B and E, as shown in FIG. 7C, then the toner particles T over the electrodes A and D will receive a force of repulsion from electrodes A and D, as well as receiving a force of attraction from electrodes B and E, and hence the negatively charged toner particles T move to the electrode B and electrode E. Furthermore, at the next timing, if the electrodes B and E both assume a voltage of "0", while a voltage of "+" is applied to electrodes C and F as shown in FIG. 7D, then the toner particles T over the electrodes B and E will receive a force of repulsion from electrodes B and E, as well as receiving a force of attraction from electrodes C and F, and hence the negatively charged toner particles T move to the electrode C and electrode F. In this way, the negatively charged toner is conveyed successively toward the right in the diagrams, due to a traveling wave electric field.

By applying a drive waveform (voltage) of multiple phases (n phases) and changing voltage to the plurality of electrodes 102 in this way, a traveling wave electric field is generated on the toner conveyance member 22, and the negatively charged toner particles are moved in the direction of travel of this traveling wave electric field. If the toner is positively charged, then the toner can be moved similarly in the same direction, by reversing the pattern of change of the drive waveforms.

Figure 8:
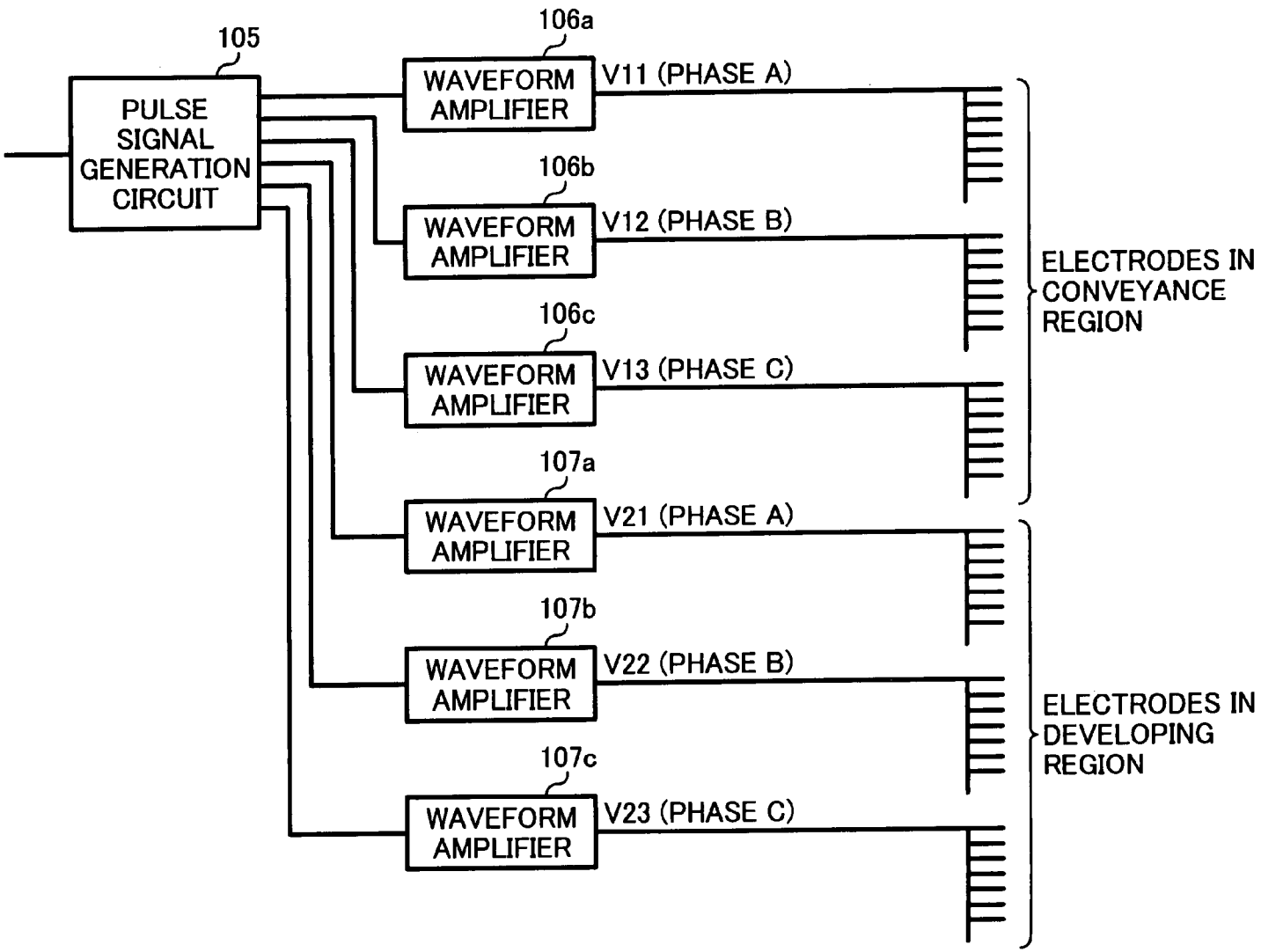
FIG. 8 is a block diagram showing one example of the composition of a voltage application device corresponding to the aforementioned toner conveyance member.

Next, one example of a voltage application device 104 is described with reference to FIG. 8.

This voltage application device 104 comprises: a pulse signal generating circuit 105 which generates and outputs a pulse signal; waveform amplifiers 106*a*, 106*b*, 106*c*, which generate and output pulse-shaped voltages V11, V12, V13 to form drive waveforms, by inputting the pulse signal from the pulse signal generating circuit 105; and waveform amplifiers 107*a*, 107*b* and 107*c*, which generate and output drive waveforms V21, V22, V23 by inputting the pulse signal from the pulse signal generating circuit 105.

The pulse signal generating circuit 105 receives an input pulse having a logic level, for example, and generates and outputs a pulse signal, comprising two sets of pulses respectively shifted in phase by 120°, having an output voltage of 10-15V which is capable of driving and performing 100V switching of the switching devices, such as transistors, contained in the downstream waveform amplifiers 106*a*-106*c* and 107*a*-107*c*.

The waveform amplifiers 106*a*, 106*b* and 106*c* apply drive waveforms (drive pulses) of three phases, V11, V12, V13, to the electrodes 102 in the conveyance region, and the waveform amplifiers 107*a*, 107*b* and 107*c* apply drive waveforms (drive pulses) of three phases, V21, V22, V23, to the electrodes 102 in the developing region.

Figure 9:
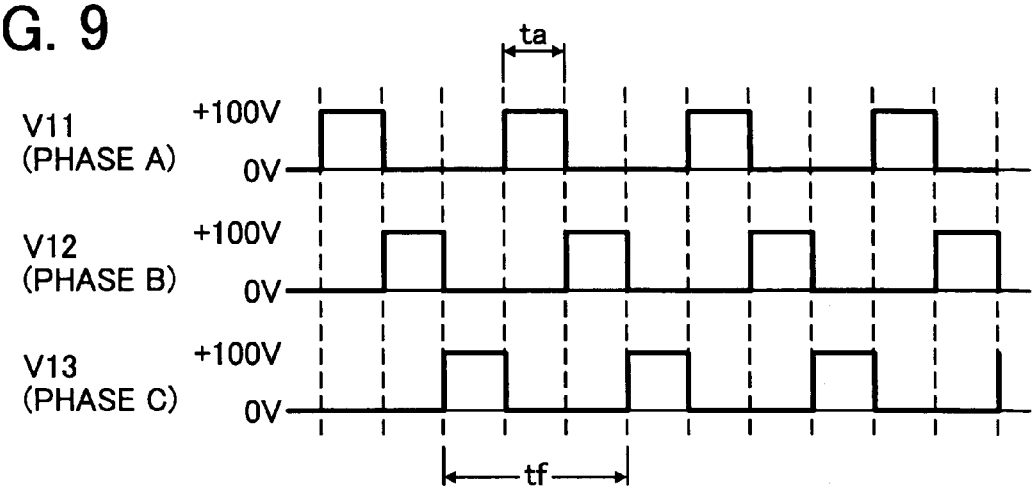
FIG. 9 shows one example of voltage waveforms applied in the conveyance region of the aforementioned conveyance member.

Here, in the conveyance region of the toner conveyance member 22, the drive waveforms of three phases (drive pulses), V11, V12, V13, applied to the electrodes 102 are set in such a manner that the application time ta of the +100V voltage in each phase is ⅓, or approximately 33%, of the repetition period tf (this is also called a "conveyance voltage pattern") as shown in FIG. 9. These drive waveforms are suitable for conveying the toner at high speed in the conveyance region.

Figure 10:
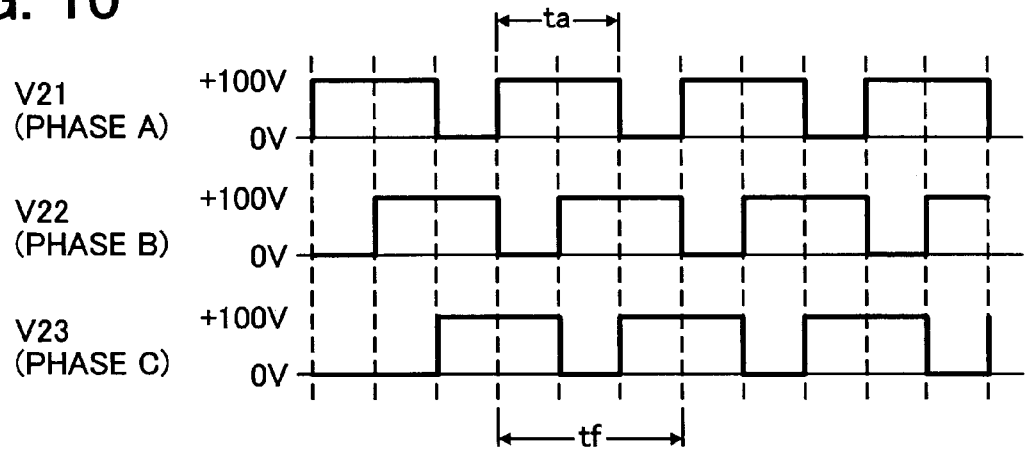
FIG. 10 is a diagram showing one example of voltage waveforms applied in the developing region of the aforementioned toner conveyance member.
Figure 11:
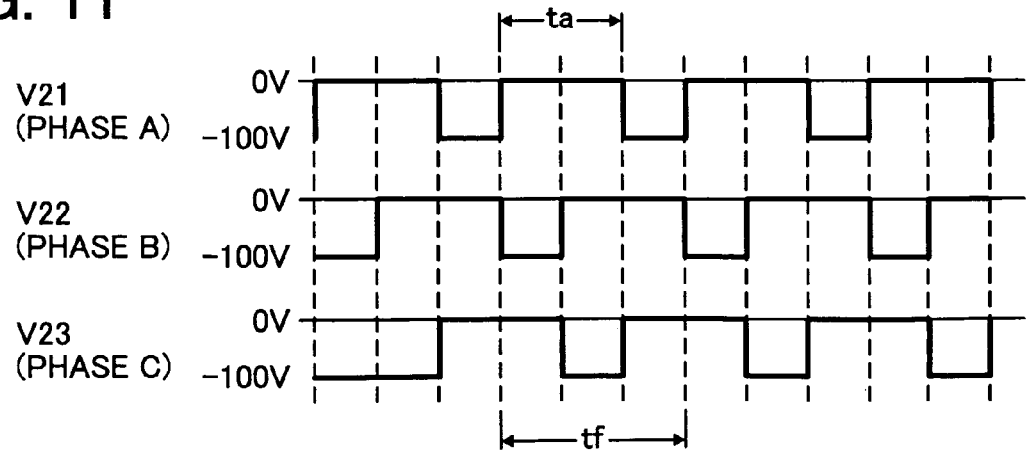
FIG. 11 is a diagram showing a further example of voltage waveforms applied in the developing region of the aforementioned toner conveyance member.

Furthermore, in the developing region, as shown in FIG. 10 or FIG. 11, the drive waveforms (drive pulses) of three waveforms, V21, V22, V23 applied to the electrodes 102 are set in such a manner that the application time ta of the +100V (or −100V) voltage in each phase is ⅔, or approximately 67%, of the repetition period tf (this is also known as a "hopping voltage (or development voltage) pattern"). In this developing region, it is desirable that the toner particles should be propelled actively upward toward the image carrier, and the drive waveforms shown in FIG. 10 are suitable for propelling the toner particles upward in this fashion.

Even when the drive waveforms of the development voltage pattern are applied, the toner particles other than the toner located at the center of an electrode at 0V also receive a force in the lateral direction, and therefore, rather than all of the toner being propelled upward together to a large height, some of the toner particles also move in a horizontal direction. Conversely, even when the drive waveforms of the conveyance voltage pattern are applied, depending on their position, some of the toner particles are propelled upward obliquely at a large angle, and hence are moved by a greater distance in the upward direction, than the distance by which they are conveyed in the horizontal direction.

Consequently, the drive waveform patterns applied to the electrodes 102 in the conveyance region are not limited to the conveyance voltage pattern shown in FIG. 9 described above, and similarly, the drive waveform patterns applied to the electrodes 102 in the developing region 12 are not limited to the development voltage pattern shown in FIG. 10 described above.

The drive waveform has been described here with reference to a case of three phases, but if this is generalized as n phases, then the following description applies. Namely, if a traveling wave electric field is generated by applying pulse-shaped voltages (drive waveforms) of n phases (where n is an integer equal to or greater than 3) to the electrodes, then by setting a voltage application duty whereby the voltage application time per phase is less than (repetition period×(n−1)/n), it is possible to achieve highly efficient conveyance and development. For example, if drive waveforms of three phases are used, then the voltage application time ta in each phase is set to be less than ⅔, or approximately 67%, of the repetition period tf, and if using drive waveforms of four phases, then desirably, the voltage application time of each phase is set to be less than ¾, or 75%, or the repetition period tf.

On the other hand, it is desirable to set the application voltage duty to be equal to or greater than (repetition period/n). For example, if drive waveforms of three phases are used, then it is desirable to set the voltage application time ta of each phase to be equal to or greater than ⅓, or approximately 33%, of the repetition period tf.

More specifically, looking at one particular electrode, it is possible to improve efficiency by setting the time periods for the voltage applied to the electrode in question, and the respective voltages applied to the adjacent electrode on the upstream side and the adjacent electrode on the downstream side, in such a manner that an adjacent electrode on the upstream side in the direction of travel creates a repulsion and an adjacent electrode on the downstream side creates an attraction. In particular, if the drive frequency is high, then an initial speed for the toner over the electrode in question can be achieved readily by setting the voltage application time within the range of: equal to or greater than (repetition period/n) and less than (repetition period×(n−1)/n).

Here, one example of the waveform amplifiers 107*a*-107*c* which generate the voltage waveforms of the hopping voltage pattern shown in FIG. 11 and described above will be explained, with reference to FIG. 12, (in which the amplifier is labeled with the reference numeral "107").

Each phase of the drive waveforms of the hopping voltage pattern shown in FIG. 11 is a pulse waveform of 0-−100V, having a 67% duty for the time during which the electric potential is relatively positive (0V time period), but here, it is described as a waveform having a 33% duty for the time during which the electric potential is relatively positive (0V time period).

The waveform amplifier 107 comprises resistances R1 and R2 for splitting the voltage of the input signal, a transistor Tr1 for switching, a collector resistance R3, a transistor Tr2, a current limiting resistance R4, and a clamp circuit 25 comprising a capacitor C1, a resistance R5, and a diode D1.

Figure 13A:
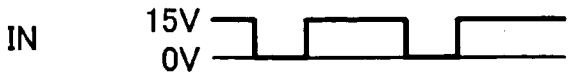
FIGS. 13A to 13C are diagrams showing voltage waveforms applied to the aforementioned waveform amplifier.
Figure 13B:
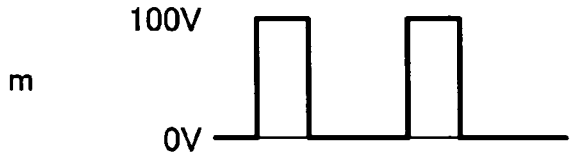

As shown in FIG. 13A, when the pulse signal generating circuit 105 supplies an input signal having a 15V duty of approximately 67% and the 0-15V waveform shown in the diagram, for example, to the waveform amplifier 107, then this input signal IN is split by the resistances R1 and R2, and is input to the base of the transistor Tr1. By means of a switching operation in the transistor Tr1, the phase of the signal is reversed, and a voltage waveform (collector voltage) m having a level boosted to 0-+100V such as that shown in FIG. 13B is obtained.

Figure 13C:
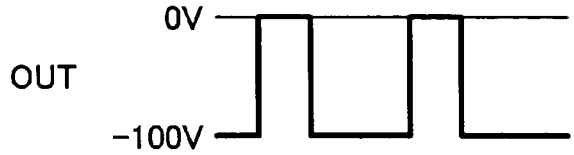

The transistor Tr2 receives this collector voltage m, and outputs a waveform of the same level, at low impedance. The clamp circuit 108 connected to the emitter of the transistor Tr2 has a small time constant with respect to the + waveform, while the time constant with respect to the − waveform is determined by the capacitance C1 and the resistance R5. However, by setting this time constant to a sufficiently high value with respect to the pulse frequency, it is possible to obtain an output waveform OUT of 0-−100V having a clamped 0 level from the clamp circuit 108, as shown in FIG. 13C.

Figure 14:
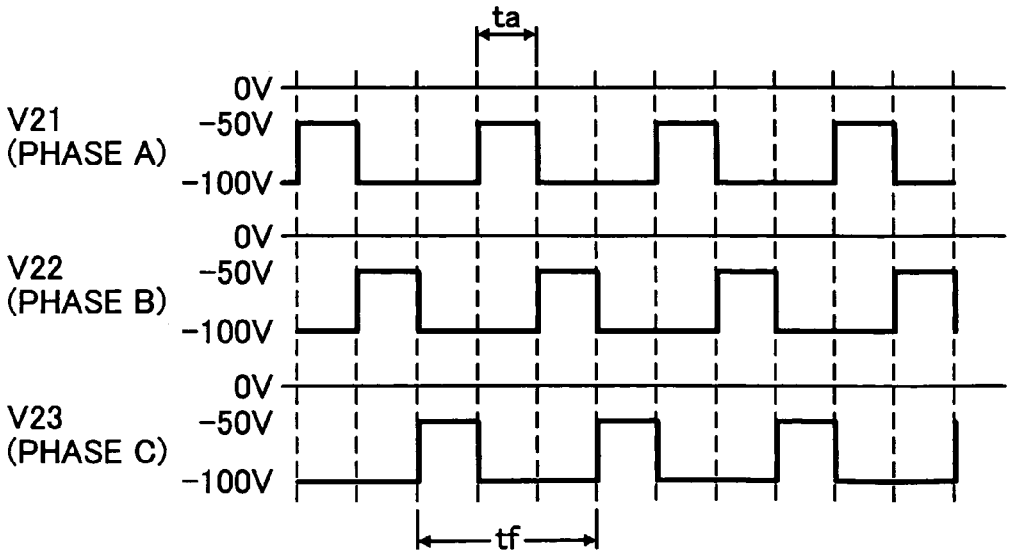
FIG. 14 is a diagram showing a further example of voltage waveforms applied in the conveyance region of the aforementioned toner conveyance member.

Furthermore, as shown in FIG. 14, the hopping voltage pattern may also use voltages having a waveform in which a DC bias is superimposed on a pulse-shaped voltage. The waveforms shown in FIG. 14 show drive waveforms of −50V to −150V, where a DC bias voltage of −50V is applied. In this diagram also, the waveforms have a 33% duty for the time period of the relative + voltage.

Figure 12:
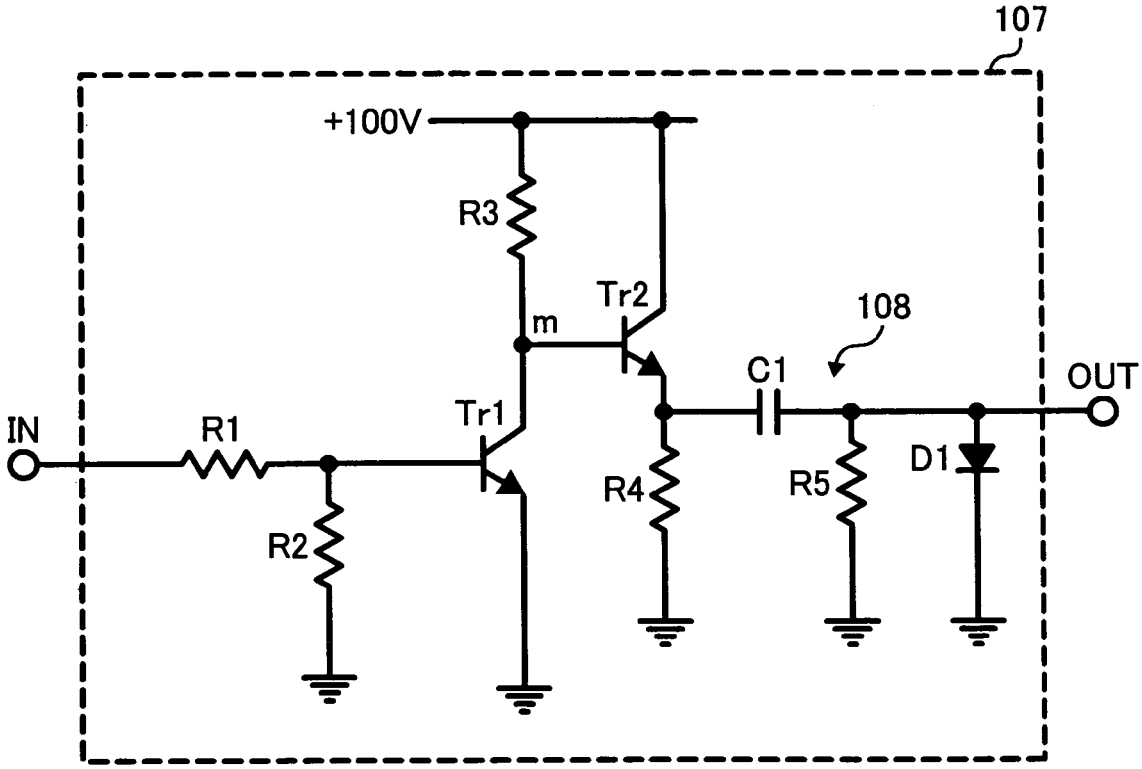
FIG. 12 is a circuit diagram showing one example of the composition of a waveform amplifier of the aforementioned voltage application device.
Figure 15:
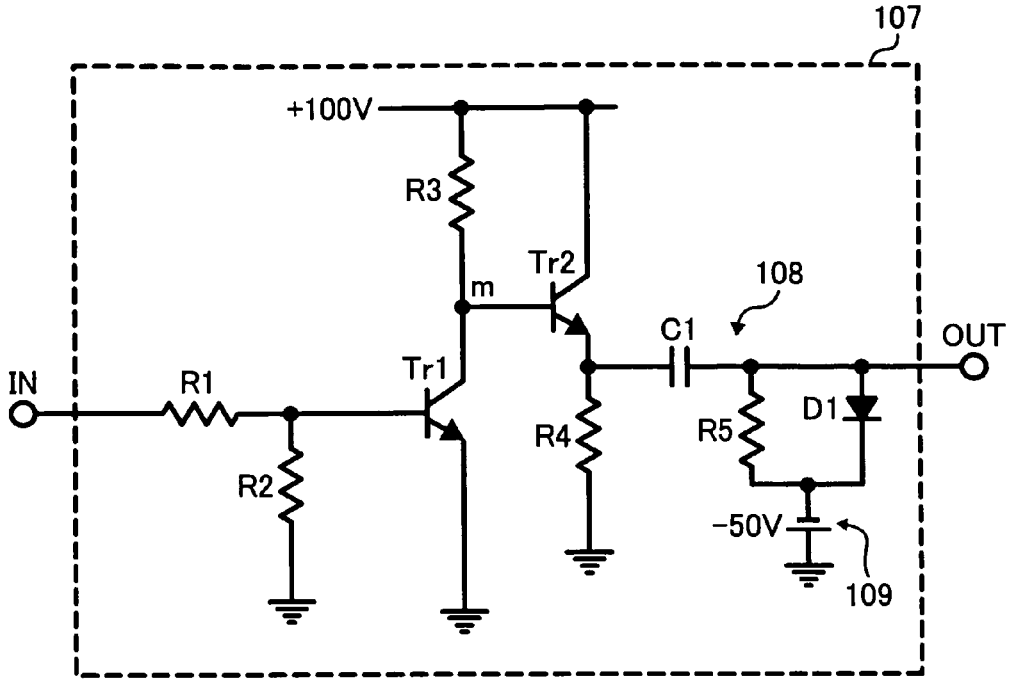
FIG. 15 is a circuit diagram showing one example of the composition of a waveform amplifier of a voltage application device which outputs the waveforms shown in FIG. 14.

As shown in FIG. 15, the waveform amplifier 107 described above for generating these drive waveforms has a −50V power supply circuit 109 inserted in series with the diode D1 and the resistance R5 in the GND direction of the clamp circuit 108 of the circuitry shown in FIG. 12. A −50V DC bias voltage is applied to the output waveform of the waveform amplifier 107, and hence a waveform that varies between −50 and −150V is obtained.

Figure 16:
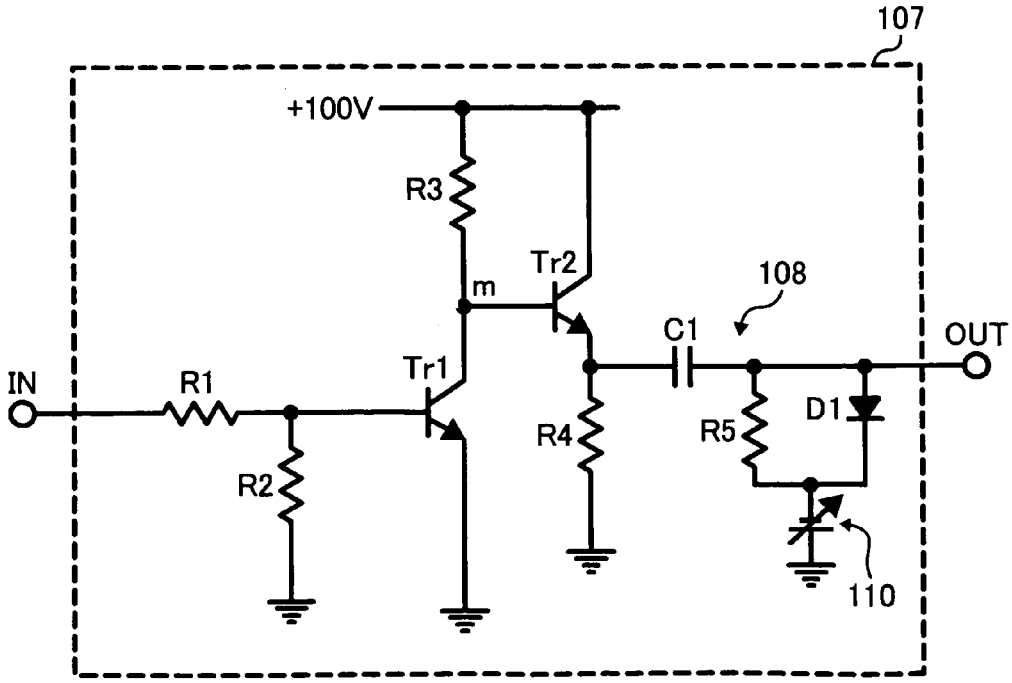
FIG. 16 is a circuit diagram showing a further example of the composition of a waveform amplifier of the aforementioned voltage application device which outputs the waveforms shown in FIG. 14.

Furthermore, as shown in FIG. 16, in the circuitry shown in FIG. 15, if a bias power supply circuit 110 having a variable output voltage is provided instead of the bias power supply circuit 109 which outputs a fixed voltage, then it is possible to alter the voltage value of the DC bias voltage. In this case, the output of the bias power supply circuit 110 is controlled by means of the control unit of the image forming apparatus.

The hopping effect in the ET effect is not produced when simply by using an electrostatic conveyance substrate, but rather, it is generated by setting the relationship between the electrode width a and the electrode pitch R of the electrodes 102 of the toner conveyance member 22, and the drive waveform (voltage) applied to the electrodes. This point is described in detail in PRIOR ART 2, and the like.

For example, in respect of the electrode width a of the electrodes 102, if the electrode width a is equal to the toner particle size, then this is a width dimension which allows at least one toner particle to be placed over the electrode and conveyed and caused to hop. If the electrode width a is narrow than this, then the electric field acting on the toner will decline, and the conveyance force and the propulsion force will fall and not be sufficient for practical purposes. Furthermore, as the electrode width a increases, and particularly, in the vicinity of the center of the upper surface of the electrode, the lines of electric force become inclined in the direction of travel (the horizontal direction) and a region of weak electric field in the vertical direction is created, which means that only a small hopping force is generated in this region. If the electrode width a is too large, then in extreme cases, a mirror image force and a Van der Waals force corresponding to the electrical charge of the toner, and an adsorption force due to moisture, or the like, become predominant, leading to accumulation of toner particles.

Therefore, from the viewpoint of the efficiency of the conveyance and hopping actions, provided that the electrode width allows approximately 20 toner particles to be collected over the electrode, then adsorption is not liable to occur, and the conveyance and hopping actions can be performed in a highly efficient manner, with a low-voltage drive waveform of approximately 100V. If the electrode is wider than this, then regions of partial adsorption occur. For example, if the average particle size of the toner is taken to be 5 μP, then this corresponds to an electrode width range of 5 μm to 100 μm.

A more desirable range for the electrode width a of the electrode 102 is between two times or more the average particle size of the toner and ten times or less the average particle size, in order to achieve more efficient driving at a low-voltage, where the applied voltage is 100V or less. By setting the electrode width a within this range, the decline in the electric field in the vicinity of the central region of the surface of the electrode is restricted to ⅓ or less, and the decline in hopping efficiency is 10% or less, which means that there is no significant fall in efficiency. If the average particle size of the toner is taken to be 5 μm, then this corresponds to an electrode width range of 10 μm-50 μm.

Even more desirably, the electrode width a is kept within a range of between two times or more the average particle size of the toner and six times or less the average particle size. If the average particle size of the toner is taken to be 5 μm, then this corresponds to an electrode width range of 10 μm to 30 μm. It has been found that by setting the electrode width to this range, extremely good efficiency is obtained.

Furthermore, an electric field capable of applying a sufficient force to create a conveyance and hopping effect in the toner particles is 0.5 V/μm or above, and a more desirable electric field range which avoids problems of adsorption is 1V/μm or above. Furthermore, it is considered that an even more desirable electric field range, which is also capable of imparting sufficient force, is a range of 2V/μm or above.

With respect to the electrode pitch R, since the electric field intensity in the conveyance direction declines, as the pitch becomes larger, then similarly to the value ranges for the electric field intensity, a range of one or more times the average particle size of the toner to 20 or fewer times the average particle size, and more desirably, a range of two or more times to 10 or fewer times the average particle size, and even more desirably, a range of two or more times to six or fewer times the average particle size, is selected for the electrode pitch R. Moreover, although the hopping efficiency falls as the electrode pitch R becomes larger, a practicable hopping efficiency can still be obtained at up to 20 times the average particle size of the toner. When the electrode pitch R exceeds 20 times the average particle size of the toner, then the adsorptive force on a large number of toner particles can no longer be overlooked, and there will be toner particles that do not hop at all. Therefore, from this viewpoint, it is necessary for the electrode pitch R to be equal to or less than 20 times the average particle size of the toner.

Furthermore, it is also known that conveyance and hopping are performed efficiently with the electrode composition described above, if Q/m is −3 to −40 μC/g, and more desirably, −10 to −30 μC/g, when the average particle size of the toner is 2-10 μm and the charge is negative, or if Q/m is +3 to +40 μC/g, and more desirably, +10 to +30 μC/g, when the charge is positive.

Furthermore, if the differential between the electric potential Vi of the image portions and the electric potential of the non-image portions (electric potential of blank surface sections) Vg is 300V or less, then it is possible to form a more desirable image. Moreover, the conveyance of the toner can be performed even more reliably, if the voltage applied to the electrodes 102 of the toner conveyance member 22 is set to a voltage whereby the maximum value of the electric field in the toner conveyance direction, as created when a voltage of a component attracting the toner and a voltage of a component repulsing the toner are applied to mutually adjacent electrodes 102, 102 of the toner conveyance member 22, is equal to or greater than 2V/μm.

Here, in the ET effect, developing is performed by reducing the force of adsorption between the toner particles and the toner conveyance member 22 to zero, by causing the toner to hop up above the toner conveyance member 22, but simply causing the toner to hop up above the toner conveyance member 22 is not sufficient to guarantee reliable adherence of toner to the latent image on the image carrier 1, even if the hopping toner is caused to travel toward the image carrier 1. In particular, if a toner image is formed by superimposing toners of a plurality of colors on the image carrier, then in many cases, the non-image portions of a toner image that is to be developed may correspond to image portions of the toner of another color, and in these cases, color irregularities or color mixing may occur, leading to a marked decline in image quality.

Therefore, the relationship between the potential of the latent image on the image carrier 1 (surface potential) and the potential applied to the toner conveyance member 22 (the electric field generated by same), is set to a prescribed relationship, in other words, an electric field is generated which directs the toner toward the image carrier 1 in the image portions of the latent image on the image carrier 1, but which does not direct the toner toward the image carrier 1 in the non-image portions. By this means, the toner is deposited reliably on the image portions of the latent image, whereas the toner is not directed toward the image carrier 1 in the non-image portions. Therefore, the toner caused to hop up from the toner conveyance member 22 is used efficiently for development, while preventing scattering of the toner, and hence high-quality development which is free of color irregularities can be achieved, by means of low-voltage driving.

There follows an explanation of image formation by means of color superimposition in an image forming apparatus having the composition described above.

Firstly, the voltage application device 104 applies a voltage to the electrodes 102 of the respective toner conveyance members 22 in the developing apparatuses 4Y, 4M, 4C and 4K which develop the latent images by means of toners of different colors, the average potential of this voltage being between the potential of the image portions of the latent image and the potential of the non-image portions. By this means, an electric field is created which directs the toner toward the image carrier 1 in the image portions of the latent image on the image carrier 1, but which does not direct the toner toward the image carrier 1 in the non-image portions, and hence the toner particles are deposited reliably on the image portions of the latent image, whereas no toner is deposited on the non-image portions. Consequently, the toner made to hop up from the toner conveyance member 22 is used efficiently for development.

Here, the average value of the electric potential applied to the electrodes 102 of each toner conveyance member 22 is the average value of the electric potential on the toner conveyance member 22, in terms of both space and time. As described previously, by applying a pulse-shaped voltage from the voltage application device 104, the electrodes 102 in the toner conveyance member 22 are supplied with a potential which changes periodically, but the surface of the image carrier 1 in the developing section, which is positioned at a certain distance from the toner conveyance member 22, assumes an average potential.

In other words, provided that the duty of the drive voltage pattern applied to the electrodes 102 of the toner conveyance member 22 is 50%, this potential will be the average of the high-level potential and the low-level potential of the drive voltage pattern. Consequently, it is possible to achieve high-quality development by setting this average potential to a value between the potential of the image portions of the latent image on the image carrier 1 and the potential of the non-image portions thereof.

Moreover, if the present EH development method is used, then it is possible to obtain a high-quality image, efficiently, even if forming a color image. In other words, in the EH effect, the toner is attracted to and deposited on the image portions of the latent image, by causing the toner to hop up, whereas no toner is deposited in the non-image portions. Therefore, toner particles are deposited faithfully on the electric field of the latent image on the photosensitive body. In this case, since no force of adsorption is generated between toner particles that have already been made to hop up, and the toner conveyance member 22, then it is not necessary to create a strong force in order to pull the toner particles away from the toner conveyance member 22, and hence the toner can be moved readily to side of the image carrier 1. Therefore, high-quality development can be achieved at low voltages.

In this way, since a large force is not required in order to pull the toner particles away from the toner conveyance member 22, when forming one toner image over another toner image in order to superimposed different colors, then the new toner image can be superimposed without disturbing the existing toner image.

Therefore, as described above, even in the case of the second or subsequent color, by applying a voltage to the electrodes 102 of the toner conveyance member 22 from the voltage application device 104 so as to create, in the developing region, an electric field which directs the toner particles toward the image carrier 1 in the image portions of the latent image, but which does not direct the toner particles toward from the image carrier 1 in the non-image portions, in respect of the toner of the color that is currently to be developed, then it is possible to achieve satisfactory development without disturbing the toner already present on the image carrier 1.

Next, a case where an image is formed by superimposing toners of a plurality of colors onto a image carrier 1 will be described with reference to a concrete example.

The case of the first toner can be regarded as being similar to the case of forming a monochrome image. In other words, in the case of a pulse-shaped voltage which changes between 0 and −100V, as in the voltage waveforms of the hopping voltage pattern shown in FIG. 11 and described above, then if the potential of the non-image portions on the image carrier 1 is lower than −100V, the toner will be attracted to the side of the toner conveyance member 22 in the non-image portions. On the other hand, by setting the potential of the image portions to a suitable value, the toner particles are made to travel to the image carrier 1 in the image portions.

On the basis of experimentation, it was found that, if the potential of the non-image portions in the latent image is set to −150V or −170V, then the toner does not travel to the side of the image carrier 1 in the non-image portions, and if the potential of the image portions is set to −20V, then the toner particles travel toward the image carrier 1 in the image portions.

Thereupon, a second toner layer is formed on the image carrier 1 on which this toner image has been formed. As a hopping voltage pattern applied to the electrodes 102 of the toner conveyance member 22 of the developing apparatus which conveys the second toner, a pulse-shaped voltage waveform which changes between −50 and −150V (the pattern shown in FIG. 14) was set. In this case, provided that the potential of the non-image portions of the latent image is less than −150V, then the toner particles ought not to travel toward the image carrier 1 in the non-image portions. It was confirmed that, if the potential of the non-image portions of the latent image is set to −200V to −220V, then the toner does not travel to the side of the image carrier 1 in the non-image portions, whereas the toner does travel to the image carrier 1 in the image portions. Furthermore, the potential of the image portions of the latent image was taken to be −50V in the development of the second color, and in this case, the toner traveled to the image carrier 1 in the image portions.

Similarly to the development of a single color only, by setting the average electric potential of the hopping voltage to a value between the potential of the image portions and the potential of the non-image portions, it is possible to make the toner travel selectively toward the image carrier, in the image portions, and therefore, scattering of the toner can be prevented and a satisfactory image can be obtained.

In this way, by providing developing devices which includes a toner conveyance member, and a voltage application device that applies a voltage having an average potential between the potential of the image portions of the latent image and the potential of the non-image portions, to the electrodes of the toner conveyance members of the respective developing devices, then it is possible to deposit the toner reliably on the image portions, to reduce the adherence of toner to the non-image portions, and thus to obtain satisfactory images which are free of image disturbance, when forming an image by superimposing toner images of different colors.

In the development of the second and subsequent colors, the image portions that are to be developed may contain portions in which toner has already been deposited in the development of a preceding color. In this case, the average electric potential of the hopping voltage is set to a value between the potential of the image portions, which has been reduced by the charge held by the toner, and the potential of the non-image portions. Thereby, it is possible to make the toner travel toward the image carrier in the image portions, while preventing the toner from traveling toward the image carrier in the non-image portions.

For example, if the image portion that is to be developed includes a portion where toner has been deposited in a previous development step, and if the charge of the toner already deposited onto the image carrier has a negative polarity, the potential of the image portion will be reduced accordingly. Therefore, in this case, it is possible to make the toner travel toward the image carrier in the image portions, by setting the average value of the hopping voltage to a value between this reduced potential of the image portions and the potential of the non-image portions.

Similarly, when the toner already deposited on the image carrier still holds a charge from the development process for that toner, then if that the polarity of the charge on the toner is negative, the potential of the image portions will fall accordingly. Consequently, in this case also, it is possible to make the toner particles travel selectively to the image carrier in the image portions, by setting the average value of the hopping voltage to a value between the reduced potential of the image portions and the potential of the non-image portions.

Moreover, when the toner already deposited on the image carrier has a charge imparted by charging or light exposure after its deposition on the image carrier, then if the polarity of the charge on the toner is negative, the potential of the image portions will fall accordingly. Therefore, in this case also, it is possible to make the toner travel selectively toward the image carrier in the image portions, by setting the average value of the hopping voltage to a value between the reduced potential of the image portions and the potential of the non-image portions.

There follows a description of the potential of the image portions of a toner image in a case where an image portion that is to be developed coincides with a region where toner has already been deposited onto the image carrier. This description refers to FIG. 17A and FIG. 17B.

Figure 17A:
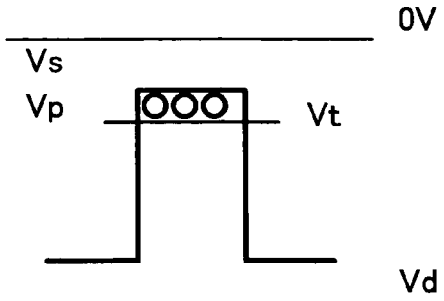
FIGS. 17A and 17B are illustrative diagrams for describing the potential of an image portion when toner has already been deposited in the region of the image portion that is to be developed.
Figure 17B:
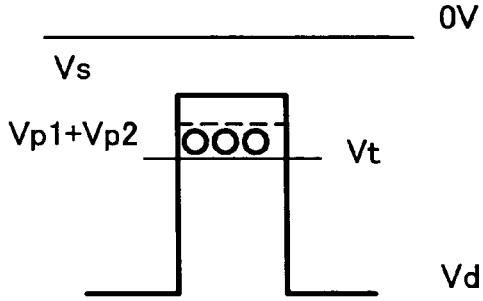

In FIG. 17A and FIG. 17B, the potential of the non-image portion is −Vd, and the potential of the image portion of the latent image is Vs. As shown in FIG. 17A, if the potential after deposition of toner T onto the image portion is Vt, then this potential Vt includes both the potential Vs of the latent image and the potential Vp of the toner particle T itself.

Next, when forming a latent image in order to deposit toner of a second color, a charge is applied to the toner layer by a charging apparatus 2, and when this is exposed to light by the writing apparatus 3, then as shown in FIG. 17B, the potential Vt of the toner layer becomes a potential including the potential Vs2 of the image portion of the latent image, the potential Vp held by the toner image, and the potential Vp2 applied to the toner by the charging process.

In a process which does not perform charging before developing the second toner layer, the potential Vp2 added by the charging process is not relevant, and furthermore, in a process with removes the charge from the toner on the photosensitive body before forming the latent image on the second color, the potential Vp can be ignored when developing the second color.

In this way, in the EH effect, it is possible to achieve development of high quality at a low voltage compared to other development methods, and furthermore, since the development is unidirectional, the process of superimposing toners of a plurality of colors on an image carrier can be carried out readily, without creating color mixing. More specifically, it is possible to form development at a potential difference of 300V or less between the image portions and the non-image portions on the image carrier 1.

In other words, in the first embodiment, by providing developing devices including toner conveyance members, and voltage application devices which apply a voltage having an average potential value between the potential of the image portions on the image carrier, which is reduced by the charge held by the previously developed toner, and the potential of the non-image portions, to the electrodes of the toner conveyance members of the developing devices corresponding to at least the second and subsequent colors, of the respective developing devices, then it is possible to obtain a satisfactory multi-color image when forming images by superimposing toner images of different colors, even if the potential of the image portions is reduced by the charge held by previously developed toner, in the development of the second and subsequent colors.

Furthermore, by providing developing devices including toner conveyance members for conveying toner, and voltage application devices which apply a voltage having an average potential value between the potential of the image portions on the image carrier, in which the charge held by previously developed toner has increased due to the charging performed before forming the latent image to be developed in the current developing device, and the potential of the non-image portions, to the electrodes of the toner conveyance members of the developing devices corresponding to at least the second and subsequent colors, of the respective developing devices, then it is possible to obtain a satisfactory multi-color image when forming images by superimposing toner images of different colors, even if the charge of the previously developed toner has increased due to charging prior to latent image writing in the development of the second and subsequent colors.

Moreover, by providing developing devices including toner conveyance members for conveying toner, and voltage application devices which apply a voltage having an average potential value between the potential of the image portions on the image carrier, which is reduced by the charge held by the previously developed toner and by the increased charge of the toner due to charging performed before forming the latent image to be developed in the current developing device, and the potential of the non-image portions, to the electrodes of the toner conveyance members of the developing devices corresponding to at least the second and subsequent colors, of the respective developing devices, then it is possible to obtain a satisfactory multi-color image when forming images by superimposing toner images of different colors, even if the potential of the image portions in the development of the second and subsequent colors has been reduced by the charge held by the previously developed toner, and the increased charge of the toner due to charging performed prior to the image writing step.

Below, a concrete description is given on the basis of experimental examples of the first embodiment. In these experimental examples, experiments were carried out to form two-color toner images on a photosensitive body forming an image carrier.

Experimental Example 1

A uniform charge was created on a drum-shaped photosensitive body having a diameter of 60 mm, by means of a scrotron charger. Thereupon, an electrostatic image was formed on the photosensitive body by irradiating laser light corresponding to a pattern. Toner was deposited selectively by means of the present EH method, onto this electrostatic latent image, thereby creating a visible image. In the present experiments, the steps from the uniform charging of the photosensitive body until the deposition of toner where repeated a second time, thereby forming a two-color image on the photosensitive body. In an actual system, images are commonly formed by using toners of four different colors, and the steps are repeated in accordance with the number of colors of toner, thus forming a multi-color image on the photosensitive body. However, here, the same evaluation was obtained by using two-colors. The image is then transferred to a transfer material and fixed, thereby obtaining an image. In this experiment, the image on the photosensitive body after formation of a two-color toner image was evaluated. The toner of the first color was cyan and the toner of the second color was magenta. The average charge of the toner was approximately −20 μC/g in the case of both colors.

More specifically, the photosensitive body was charged uniformly to approximately −130V, and then laser light was irradiated onto the photosensitive body in order to form a cyan pattern. Thereby, a latent image was formed on the photosensitive body, in which the portions irradiated with laser light formed image portions having a potential of approximately −15V, while the non-image portions had a potential of approximately −130V.

Thereupon, an ET effect was created. Similarly to the waveforms shown in FIG. 11, the voltages applied to the electrodes of the toner conveyance member had a three-phase, 3-kHz frequency, 50% duty pattern, with a high-level potential of 0V and a low-level potential of −100V. The potential of the image portions after development was approximately −30V, and the potential of the non-image portions was approximately −120V. In this state, the photosensitive body on which cyan toner had been deposited was removed and taken to an inspection room. Toner had been deposited on the image portions, whereas no toner had been deposited on the non-image portions.

In this case, the potential of the image portions was approximately −15V and the potential of the non-image portions was 0V. In the inspection room, the potential of the photosensitive body was virtually 0, and the electrical potential −15V measured in the image portions was considered to be a potential caused by the charge held by the toner particles.

Thereupon, an experiment for superimposing two colors was carried out. After forming a cyan toner image on the photosensitive body by the method described above, the photosensitive body was charged again by the scrotron charger. The photosensitive body was charged so as to have a potential of approximately −300V after charging. A pattern for the second color, magenta, was then written onto the cyan toner image, by means of a laser. The potential of the image portions after writing was approximately −75V, and the potential of the non-image portions was approximately −300V.

Thereupon, an ET effect was created. Similarly to the waveform shown in FIG. 14, the voltage applied to the electrodes of the toner conveyance member had a high level of −50V and a low level of −150V. When the photosensitive body was removed for inspection after development, it was seen that a magenta toner layer had been deposited over the cyan toner layer, while no deposition of toner was observed in the non-image portions.

The potential of the image portions after removal to the inspection room was approximately −60V, which is approximately −45V lower than the potential of the toner layer measured after development of the first color. This is thought to be due to the potential held by the toner particles of the second color, and the charge induced in the toner of the first color by the charging action carried out before forming the toner image of the second color.

In order to make a comparison, it was attempted to perform development using the same high-level and low-level values for the drive voltage in the development of the second color, as those used for the first color. In this case, the magenta toner did not adhere to the image portions. This is thought to be because the average voltage (average potential) of the drive voltage waveform is −50V, and in the development of the second color, the average voltage applied to the electrodes of the toner conveyance member does not lie between the potential of the non-image portions and the reduced potential of the image portions.

Experimental Example 2

A toner image of the first color was formed similarly to the experimental example 1 described above, whereupon the photosensitive body on which toner had been deposited was de-charged by an AC corotron charger. The potential on the photosensitive body became almost 0V, even in the regions where there was a toner layer. Subsequently, in order to deposit magenta toner on the cyan toner, the de-charged photosensitive body was then charged uniformly to −300V, and writing was performed on top of the cyan toner, by means of a laser, thereby forming an image pattern for magenta development. The potential of the image portions in this case was approximately −60V. This value of −60V is thought to be the sum of the potential of the image portions on the photosensitive body and the potential caused by the charge induced in the toner of the first color, cyan, due to the charging step carried out prior to the development of the second color. In this case also, a satisfactory image was obtained when the second color was developed under similar development conditions to those in experimental example 1 described above.

By carrying out charge removal in this way, it is possible to reduce the change in the potential of the toner layer due to the superimposition of toners, and hence the development drive voltage can be kept to a low voltage in the case of multi-color image formation.

Furthermore, if a toner image of a first color is formed on the photosensitive body and a toner image of a second color is also formed, then the latent image for the second color is formed by charging the photosensitive body on which toner of the first color has been deposited, and then writing an image thereon.

In this case, the potential of the latent image on the toner image of the first color is approximately −70V, and therefore, an ET effect is created by applying a voltage having an average potential value of −120V. In this case, the potential of the non-image portions is −180V, and hence the average potential lies between the potentials of the image portions and the non-image portions, meaning that satisfactory development can be achieved.

Moreover, image formation for the first color was carried out under the same conditions, and the charge on the toner of the first color on the photosensitive body was then removed by means of an AC charger located in the vicinity of the photosensitive body. Thereupon, charging and exposure were carried out in order to form a latent image of the second color, and the potential of the image portions on the toner layer of the first color was measured and found to be approximately −40V. The potential of the non-image portions was −180V, and therefore, a satisfactory image was obtained when development was performed by applying a voltage creating an average potential of −120V.

Now, the relationship between the hopping voltage, the potential of the image portions, and the potential of the non-image portions in a plurality of development apparatuses will be described with reference to FIGS. 18A and 18B, with respect to a case where the toner particles are directed toward the image portions of the image carrier, whereas they are not directed toward the non-image portions of the image carrier, by setting the average potential of the hopping voltage to a value in between that of the image portions and the non-image portions on the image carrier, as described above. In each of FIGS. 18A and 18B, the diagram on the left-hand side shows the waveform of the pulse-shaped voltage applied to the electrodes 102 of the toner conveyance member 22, and the diagram on the right-hand side shows the potentials of the image portions and the non-image portions on the image carrier 1.

Figure 18A:
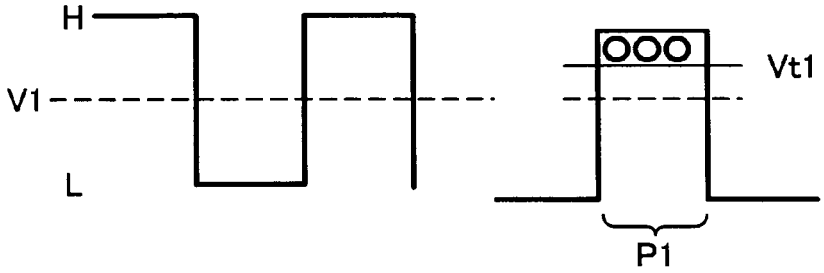
FIGS. 18A and 18B are diagrams for describing the relationship between the potential of the image portions, the potential of the non-image portions, and the average potential of the voltage applied to the electrodes of the toner conveyance members, between a plurality of development stages.
Figure 18B:
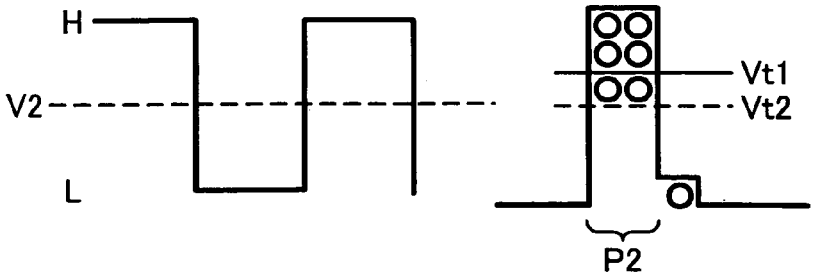

FIGS. 18A and 18B show cases where toners of a plurality of colors are deposited on one image carrier. FIG. 18A shows the first color and FIG. 18B shows the second color. Firstly, the average potential resulting when a pulse-shaped voltage having a duty of 50% is applied to the electrodes of the toner conveyance member 22 used for development of the toner of the first color, is taken to be V1.

On the other hand, the relationship between the potentials of the non-image portions and the image portions of the image pattern P1 of the first color formed on the image carrier, is as shown in FIG. 18B. Here, since a negatively charged toner is used, the higher the level of the potential in FIG. 18B, the greater the readiness of the toner to adhere to the image carrier.

Consequently, if an electric potential relationship of this kind is adopted, then the average potential V1 lies between the potential of the image portions and the potential of the non-image portions, and therefore, satisfactory development is achieved. The toner T ceases to adhere to the image portion when the potential of the toner layer Vt1 becomes lower than the average potential V1. In other words, the lower limit of the toner layer potential Vt1 is the average potential V1.

FIG. 18B considers a case where a toner of a second color has been deposited onto this toner layer. The image width of the second color is taken to be P2. In order to deposit toner onto the image width P2, it is necessary for the average value V2 of the voltage used for development of the second color to be smaller than the potential of the toner layer Vt1. Therefore, the potential of the toner layer Vt2 after development of the second toner is not lower than the average potential V2. Consequently, the lower limit of the toner layer potential Vt2 is the average potential V2.

By ensuring this relationship between the plurality of (m) developing apparatuses 4, it is possible to superimpose a toner layer of a different color on top of an existing tone layer. In other words, if the average potential of the voltage applied to the electrodes 102 of the toner conveyance member 22 used to develop the mth color (where m=1~m) is taken to be Vm, then by setting the voltages applied from the voltage application device 104 to the developing apparatuses 4 so as to satisfy the relationship $|Vm|<|Vm+1|$, satisfactory superimposed toner development can be achieved.

In this case, if the voltage applied to the electrodes of the toner conveyance member 22 comprises a DC bias superimposed on a pulse-shaped voltage (for instance, the example shown in FIG. 15), then taking the DC bias applied to the mth developing apparatus 4 to be Vdcm, the relationship $|Vdcm|<|Vdcm+1|$ s established. In other words, it is possible to establish the relationship $|Vm|<|Vm+1|$ readily, simply by altering the value of the DC bias.

In specific terms, for example, if the potential of the latent image of the first color is −170V in the non-image portions, and approximately −80V in the image portions, and if ET development is performed by applying a pulse-shaped voltage having a high level of −50V and a low level of −150V to the developing apparatus 4 of the first color, then the average value of the pulse-shaped electric potential is −100V, and hence the toner adheres satisfactorily to the image carrier.

When toner of a second color is deposited subsequently, if the potential of the image portions on the toner of the second color is approximately −100V and the potential of the non-image portions is −190V, and if the aforementioned pulse-shaped voltage having a high level of −50V and a low level of −150V is applied to the developing apparatus 4, then the average potential will be equal to the potential of the image portions. Consequently, by applying a voltage having a high level of −70V, a low level of −170V, and an average potential of −120V, to the electrodes 102 of the toner conveyance member 22 of the developing apparatus 4, the toner of the second color is made to adhere satisfactorily on top of the toner of the first color.

In this case, instead of applying a pulse-shaped voltage of this kind, it is also possible to change the average electric potential readily, by generating a ±50V pulse-shaped voltage and superimposing DC components (DC bias) of −100V and −120V respectively, onto this pulse-shaped voltage.

The embodiments described above related to an example where the average potential of the voltage applied by the voltage application device 104 to the electrodes 102 of the toner conveyance member 22 lies between the potential of the image portions and the potential of the non-image portions, but it is also possible to situate the potential at which the toner is repulsed and propelled from the toner conveyance member 22, in the pulse-shaped voltage applied by the voltage application device 104, at a value between the potential of the image portions and the potential of the non-image portions.

More specifically, it was confirmed by experimentation that, if a pulse-shaped voltage that changes between 20V and −80V is used as the voltage of the hopping voltage pattern shown in FIG. 11 and described above, and if the potential of the image portions is approximately 0V and the potential of the non-image portions is −110V, then the low-level potential in the pulse-shaped voltage (namely, the potential at which the negatively charged toner is repulsed and propelled) will be situated between the potential of the image portions of the latent image and the potential of the non-image portions, and hence, the toner will be directed toward the image carrier 1 in the image portions, and it will not be directed toward the image carrier 1 in the non-image portions, in this case also.

Consequently, even if a voltage is applied to the electrodes of the toner conveyance member, in which the potential in the pulse-shaped voltage at which the toner is repulsed and propelled is situated between the potential of the image portions of the latent image and the potential of the image portions, then the toner will adhere to the image portions, whereas toner will not adhere to the non-image portions, and therefore high-quality development can be achieved.

Consequently, by providing a voltage application device which applies, to the electrodes of the toner conveyance members of the respective developing apparatuses, a voltage comprising a pulse-shaped waveform in which the potential at which the toner is repulsed and propelled from the toner conveyance member in the pulse-shaped waveform is situated between the potential of the image portions of the latent image on the image carrier and the potential of the non-image portions, then when forming an image by superimposing toner images of different colors, the toner is made to adhere reliably on the image portions, adherence of toner to the non-image portions is reduced, and hence a satisfactory image which is free of image disturbance can be obtained.

Furthermore, by providing a voltage application device which applies, to the electrodes of a toner conveyance member of a developing apparatus performing development of at least the second or subsequent color, of the respective developing apparatuses, a voltage comprising a pulse-shaped waveform in which the potential at which the toner is repulsed and propelled from the toner conveyance member in the pulse-shaped waveform is situated between the potential of the image portions of the latent image on the image carrier, which has been reduced by the charge held by previously developed toner, and the potential of the non-image portions, then when forming an image by superimposing toner images of different colors, it is possible to obtain a satisfactory multi-color image, even if the potential of the image portions is reduced in the development of the second or subsequent colors, due to the charge held by the previously developed toner.

Moreover, by providing a voltage application device which applies, to the electrodes of a toner conveyance member of a developing apparatus performing development of at least the second or subsequent color, of the respective developing apparatuses, a voltage comprising a pulse-shaped waveform in which the potential at which the toner is repulsed and propelled from the toner conveyance member in the pulse-shaped waveform is situated between the potential of the image portions on the image carrier, in which the charge of the previously developed toner has increased due to the charging performed before forming the latent image to be developed by the current developing apparatus, and the potential of the non-image portions, then it is possible to obtain a satisfactory multi-color image, even if the charge of previously developed toner has been increased by the charging carried out prior to writing the latent image in the development of the second and subsequent colors.

Furthermore, by providing a voltage application device which applies, to the electrodes of a toner conveyance member of a developing apparatus performing development of at least the second or subsequent color, of the respective developing apparatuses, a voltage comprising a pulse-shaped waveform in which the potential at which the toner is repulsed and propelled from the toner conveyance member in the pulse-shaped waveform is situated between the potential of the image portions on the image carrier, which has been reduced by the charge held by the previously developed toner and the increase in the charge of the toner due to the charging carried out before forming the latent image that is to be developed by the current developing apparatus, and the potential of the non-image portions, then when forming an image by superimposing toner images of different colors, it is possible to obtain a satisfactory multi-color image, even if the potential of the image portions in the development of the second or subsequent colors has been reduced by the charge held by the previously developed toner or the increase in the charge of the toner due to the charging carried out prior to writing of the latent image.

$2^{nd}$ Embodiment

Next, the second embodiment of the image forming apparatus relating to the present invention will be described with reference to FIG. 19.

This image forming apparatus comprises, in addition to the image forming apparatus of the first embodiment, AC charge removal devices 20Y, 20M and 20C, which are non-contact type charge removal devices for removing the charge held by toner in a toner image formed by a previous development step, located respectively on the downstream side of the developing apparatuses 4Y, 4M and 4C, which are disposed from the upstream side to the downstream side following the circumferential direction of the image carrier 1 (the direction indicated by the arrow), and charging apparatuses 2M, 2C and 2K, disposed respectively on the downstream side of the charge removal devices 20Y, 20M and 20C. The remainder of the composition is similar to that of the first embodiment.

More specifically, as described in experimental example 2 of the first embodiment described above, in this image forming apparatus, charge is removed from the preceding toner image in the case of the second and subsequent colors, whereupon the image carrier is charged uniformly. Thereby, by removing charge from the toner on the image carrier 1 before forming the latent image of the second color, as shown in FIG. 17A and FIG. 17B described above, it is possible to ignore the potential Vp during the development of the second color.

In this way, by providing a non-contact charge removal device which removes charge from the toner in the toner image on the image carrier formed by a preceding development step, it is possible to remove charge from toner in a fashion that is not liable to affect the image carrier, and hence the influence of the charge held by the toner in the formation of the next latent image is reduced, and therefore it is possible to obtain a more satisfactory multi-color image.

More specifically, in this second embodiment, by providing one image carrier, charging devices which charge the image carrier for each color, a developing device including a toner conveyance member which conveys toner to a region opposing the image carrier by means of a conveyance electric field formed by applying a multi-phase voltage to a plurality of electrodes aligned at a predetermined interval, a voltage application device which applies a voltage having an average electric potential situated between the potential of the image portions of the latent image, and the non-image portions, to the electrodes of the toner conveyance members of the respective developing devices, or a voltage application device which applies a voltage comprising a pulse-shaped waveform in which the potential at which toner is repulsed and propelled from the toner conveyance member in this pulse-shaped waveform is situated between the potential of the image portions of the latent image and the potential of the non-image portions, then when forming an image by superimposing toner images of different colors, it is possible to deposit the toner adhere reliably on the image portions, while reducing adherence of the toner to the non-image portions, and hence a satisfactory image which is free of image disturbance can be obtained.

As described above, the ET development method is a development method which has high sensitivity with respect to the developing potential difference, and it was found that a new problem arises as a result of this sensitivity, in that if there are regions of different potential on the image carrier, then the amount of toner deposited is liable to change. More specifically, if it is sought to perform development by a toner of a certain color, and if the toner layer present on the image carrier already has an electric potential, then the development of the next toner is liable to be affected by this potential.

Figure 20:
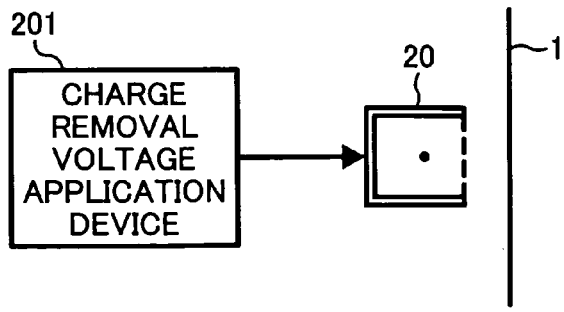
FIG. 20 is a block diagram showing the composition of a voltage application device which applies a voltage to a charge removal apparatus of the aforementioned image forming apparatus.

Therefore, in this image forming apparatus according to the second embodiment, in order to reduce the effects of the toner layer already present on the image carrier 1, in the processes relating to the second and subsequent colors, a charge removal apparatus 20 is provided, and by applying a charge removal voltage to the charge removal apparatus 20 by means of a charge removal voltage application device 201 as shown in FIG. 20, then the charge is removed after forming the toner image. Here, charge removal means either discharging by applying a charge of the opposite polarity to the charge of the toner on the image carrier or the image carrier itself, or causing the charge to leak out by creating a path along which the electrical charge can move. More specifically, by performing charge removal, the potential VP shown in FIG. 17A and FIG. 17B described above is removed.

Desirably, the charge removal apparatus 20 used here is based on a non-contact charge removal device or a non-contact charge removal method, in order to prevent disturbance of the toner image already formed on the image carrier 1.

The details of the charge removal apparatus 20 and the charge removal voltage application device 201 are described below.

For the charge removal apparatus 20, it is possible to use a corona charger, and to remove the charge by applying an AC bias from the charge removal voltage application device 201. In other words, as described previously, in order to remove the charge, it is necessary to apply a suitable electric charge of opposite polarity to charge on the image carrier 1 or the toner on the image carrier 1. Moreover, by removing the charge by applying an AC bias, the electric potential can be equalized readily by applying charge of both polarities.

In order to equalize this electric potential, it is necessary to apply a value exceeding the discharge start voltage, on both the positive and negative sides. Although it depends on the shape of the charger, and the like, an amplitude of 7 KVpp or above is desirable. In order to achieve satisfactory charge removal, it is necessary to obtain sufficient application of electric charge of the opposite polarity, while the portion to be de-charged passes under the charger, and hence the required frequency is specified in accordance with the linear speed of the image carrier.

Figure 21:
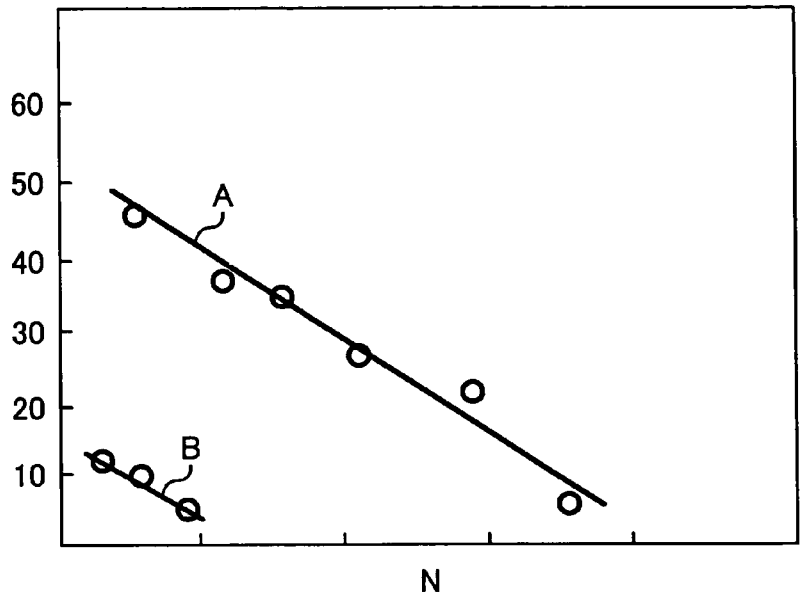
FIG. 21 is a diagram for describing the change in the potential of a toner layer when charge removal has been performed.

Here, FIG. 21 shows an example of the change in the electric potential after de-charging of the potential of the toner layer. Here, the charge removal is evaluated by taking the potential difference with respect to the potential of the non-image portions of the toner layer, as the potential of the toner layer. In FIG. 21, "N" on the horizontal axis indicates the amount of discharge, and taking v to be the linear speed of the image carrier, d to be the width of the aperture of the charge removal device, and f to be the AC frequency, then N is expressed by $N=d/v*f$.

These lines A in FIG. 21 indicate the change when charge is removed by an AC bias, and if the initial potential of the toner layer is −50V, then the potential of the toner layer after charge removal decreases as the value of N increases, and at or above a certain value, it becomes virtually zero.

In this way, by providing a plurality of charge removal devices which remove charge from the latent image carrier, positioned following the surface of the latent image carrier, then even if the developing potential difference is small, the effects of the toners already deposited on the latent image carrier are reduced, and good development can be achieved for the second and subsequent colors. By providing a voltage application device which supplies an AC bias to the charge removal device, it is possible to achieve charge removal by means of a simple composition.

Next, it is possible to use, as the charge removal voltage applied to the charge removal apparatuses 20 by the charge removal voltage application device 201, a voltage obtained by mutually superimposing an AC bias and a DC bias, in other words, it is possible to use a voltage in which an DC bias is offset with respect to the AC bias, in order to increase the charge removal efficiency.

For example, if the charge polarity on the image carrier 1 is negative, then in order to remove this charge, it is possible to increase the application of a positive electric charge, thereby improving the charge removal efficiency, by offsetting with a positive DC bias. Furthermore, if the charge polarity on the toner layer is negative, then in order to remove this charge, it is effective to offset the AC bias with a positive DC bias, and conversely, if the toner layer has a positive charge, then it is effective to offset with a negative DC bias.

The line B in FIG. 21 shows the potential of the toner layer after charge removal when a DC bias of +300V is offset, under the same AC conditions as line A. It can be seen that the value of N required for the potential of the toner layer to be zero is reduced, and hence the charge removal efficiency is improved.

In this way, by providing a voltage application device which supplies an AC bias superimposed with a DC bias, to the charge removal apparatuses, and by setting the superimposed DC bias to have opposite polarity to the potential of the image carrier, it is possible to remove the charge on the image carrier efficiently. Furthermore, by providing a voltage application device which supplies an AC bias superimposed with a DC bias to the charge removal apparatuses, and by setting the superimposed DC bias to be of opposite polarity to the potential of the image (toner image) on the image carrier before charge removal, then it is possible to remove charge from the toner image on the image carrier, in an efficient manner.

Next, it is possible to take a voltage obtained by superimposing an AC bias and a DC bias of the same polarity as the charge on the image carrier 1, as the charge removal voltage applied to the charge removal apparatus 20 by the charge removal voltage application device 201. In other words, it is possible to make the potential on the image carrier 1 after charge removal the same polarity as the polarity of the charge applied to the image carrier 1 during image formation.

By adopting a composition of this kind, it is possible to carry out the charging required for image formation, as well as charge removal, and to use a composition in which the charge is carried out at low voltage, or no charging is carried out, prior to image formation of the next color, thereby simplifying the image formation process and simplifying the apparatus.

Next, the attenuation of the laser light when performing exposing through a toner layer, which is a further effect of the toner layer adhering to the image carrier 1, will be described.

Figure 22:
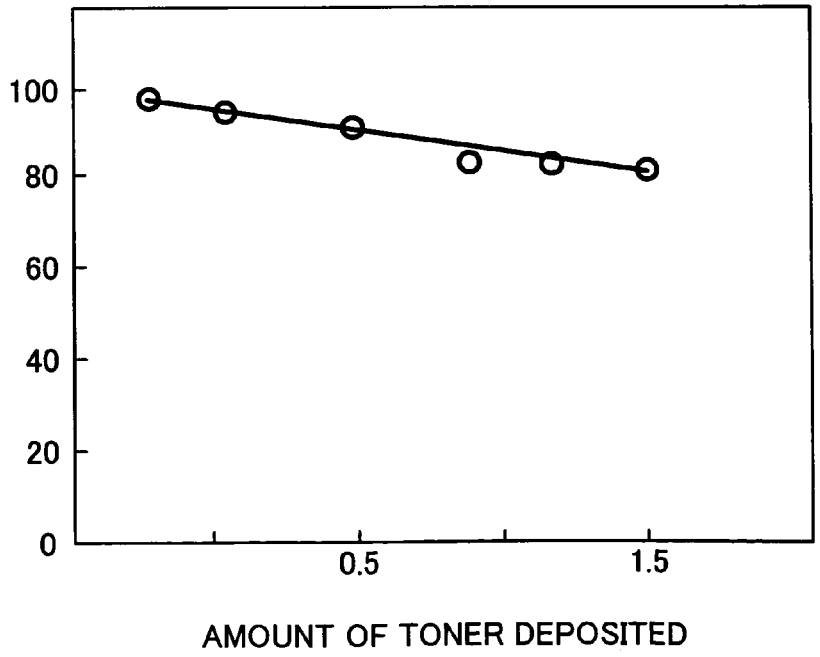
FIG. 22 is a diagram for describing the relationship between the light exposure power and the amount of toner deposited.

FIG. 22 shows the ratio between the transmissivity of the laser light with respect to the amount of deposited toner, in cases where there is toner and there is no toner. If there no change in transmissivity with the presence or absence of toner, then the value is 100%, and if there is a 20% reduction, then the value is 80%. These results show data corresponding to a case where the amount of laser light is ½ of the normal exposure light power.

Furthermore, FIG. 23 shows the potential of the image carrier with respect to the light exposure power of the laser. In FIG. 17, the light exposure power as shown in FIG. 22 is the value indicated by A1. When the light exposure power is A1, then if the light exposure power is reduced due to the presence of a toner layer, the light exposure power becomes B1, and a differential of C1 is produced in the potential of the image carrier. On the other hand, if light exposure is performed at the light exposure power A2, then the light exposure power reduced by the toner layer becomes B2, and the differential in the potential of the image carrier becomes C2.

Even if the light exposure energy has become 80% in this way, provided that the potential of the photosensitive body does not change significantly, then the photosensitive body is exposed with light of sufficient intensity and therefore it is possible to reduce the effects caused by the toner layer. More specifically, a potential difference equal to or less than 10% of the charging potential of the image carrier is desirable, and if the photosensitive body is charged to a potential equal to or greater than −300V and an image is formed, then desirably, a light exposure power creating a potential difference equal to or less than 30V is used for image formation.

In other words, by setting the intensity of the exposure light used when performing light exposure on the image carrier to a light intensity value which achieves a V1/V0 ratio of 0.9 or above, when V0 is taken to be the potential of the latent image on the image carrier when the light exposure of the first color is performed at a light exposure intensity P, and V1 is taken to be the potential of the latent image on the image carrier when light exposure is performed at a light exposure intensity of 0.8×P, then the effects of the toner already deposited on the latent image carrier during light exposure are reduced and a satisfactory image can be obtained.

In this way, in this image forming apparatus, it is possible to form a color image by rotating the image carrier 1 once only, and an intermediate transfer body is not required in order to superimpose a toner image on the image carrier. Therefore, as well as being able to reduce the size of the apparatus, it becomes possible to prevent the toner on the image carrier from being disturbed by downstream development steps, or being recovered by a downstream developer, and therefore, good images can be obtained in a stable fashion, without the occurrence of color mixing. Furthermore, by carrying out charge removal after the development of each color, there is no difference in density between portions where toner has been deposited previously and the portions where toner no tone has been deposited previously, in the output image, and therefore, a uniform image is obtained and image quality is improved.

In other words, when forming an image by carrying out the steps of charging, light exposure and development, for each color, on one image carrier, thereby successively superimposing toner images of different colors during one rotation of the image carrier, development is carried out by applying a voltage having an average potential value between the potential of the image portions of the latent image and the non-image portions, to the electrodes of the toner conveyance members which convey toner to a region opposing the image carrier by means of a conveyance electric field formed by applying a multi-phase voltage to a plurality of electrodes aligned at a predetermined interval, and therefore it is possible to form a color image by only one rotation of the image carrier 1, and furthermore, since the toner images are mutually superimposed on the image carrier, then no intermediate transfer body is required. Consequently, it is possible to reduce the size of the apparatus, and furthermore, the toner on the image carrier is prevented from being disturbed by downstream development steps, or recovered by downstream developing devices, thus making it possible to obtain satisfactory images in a stable fashion, without color mixing. Moreover, by removing charge after development of each color, there is no difference in density between portions where toner has been deposited previously and portions where toner has not been deposited previously, in the output image, and therefore, a uniform image is obtained and image quality is improved.

Next, a concrete experimental example of the second embodiment will be described.

Experimental Example 1

Figure 19:
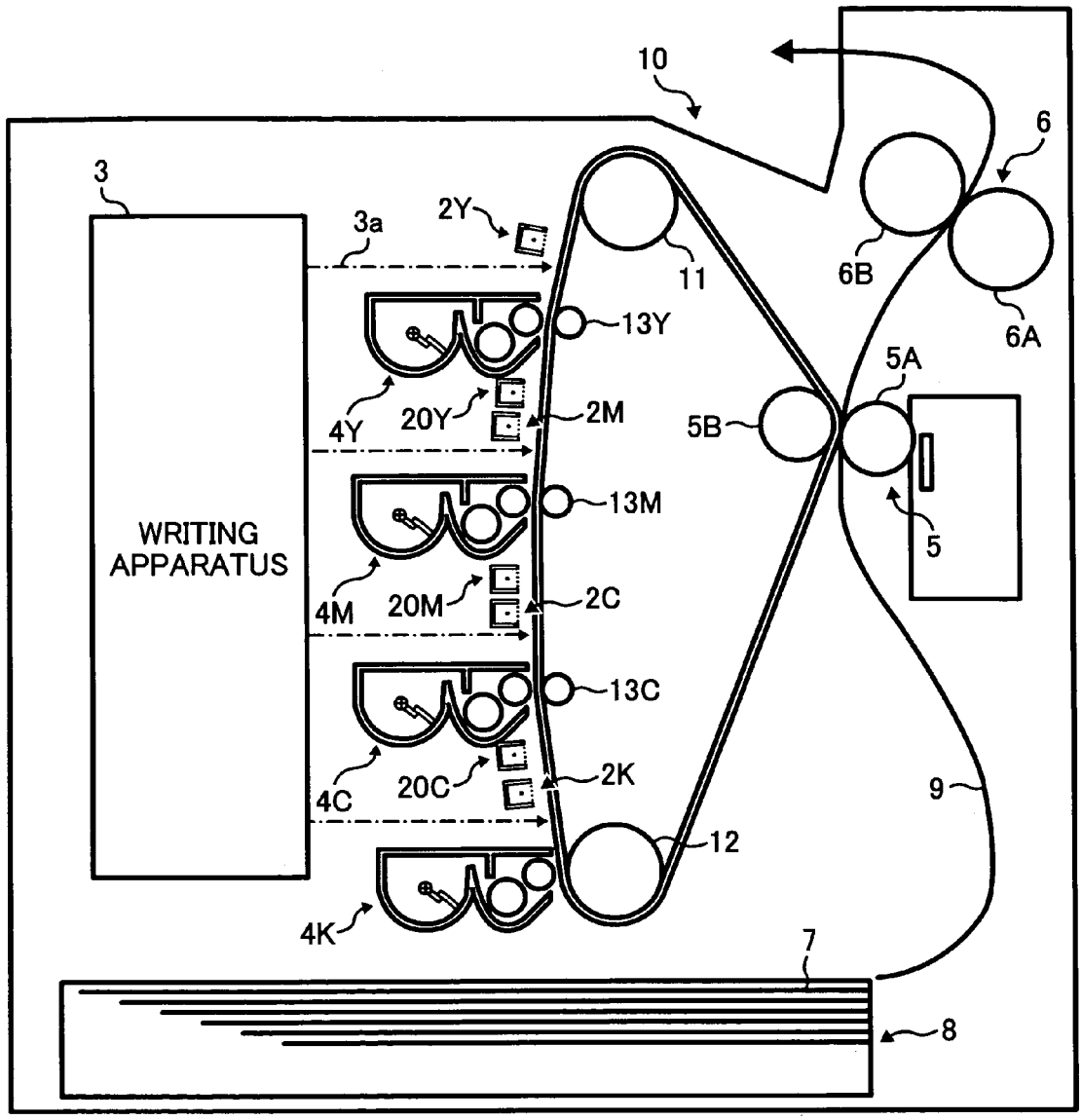
FIG. 19 is a diagram showing the approximate general composition of a second embodiment of an image forming apparatus according to the present invention.

A color pattern such as that shown in FIG. 24 was output by using the image forming apparatus shown in FIG. 19. The pattern has six sections: Y (yellow), M (magenta), C (cyan), R (red), G (green) and B (blue), and the color sequence of the toners deposited onto the image carrier 1 is Y, M, C. R is equivalent to Y+M, G, to Y+C, and B, to M+C, and writing was carried out at the same light exposure energy in each of the monochrome color sections and the secondary color sections.

Here, experiments were carried out in which charge removal was performed after forming the toner images and charge removal was not performed, and the image after transfer to paper were evaluated. The experimental conditions are shown in FIG. 25. Furthermore, the charge removal conditions involves the application of an AC bias of 8.5 kVpp at 2 kHz.

Firstly, when charge removal is not carried out, the R section assumed a color hue that is extremely close to that of Y, the B section assumed a color hue very close to that of M, and the G section assumed an almost yellow/green color. These effects are thought to be due to the difficulty of developing toner of a second color onto toner of a first color.

On the other hand, when charge removal was carried out, the image was a satisfactory one, with sufficient density in each of the colors.

Experimental Example 2

An experiment similar to that described in Experimental Example 1 above was carried out, while changing the amount of DC offset applied to the charge removal devices. Since the charging polarity required to form an image of the next color is negative, the experiment was performed using a DC offset of −250V. Since the charge removal efficiency declined markedly, when using the present apparatus, it was possible to remove charge by reducing the linear speed of the image carrier by ½. Furthermore, in an experiment using another apparatus, it was possible to remove charge at the normal linear speed of the image carrier, by using a charger which has a larger aperture diameter and creates a large flow of current. The surface potential of the photosensitive body after charge removal was almost −250V, and it was possible to obtain a satisfactory image by performing light exposure and developing, without carrying out a charging step before the image formation for the next color.

In the respective experiments described above, the LD light exposure power of the writing apparatus 3 used was set to a light exposure power which produces a potential difference of less than 5V after exposure, between a case where the energy is cut by 37% by inserting an ND filter, and a case where the energy is not cut, assuming that the initial charging potential of the image carrier 1 used to be −300V. When a similar experiment was carried out while using an ND filter to cut the energy by 50%, it was confirmed that the secondary colors were not reproduced at all, if the charge removal step was not carried out.

3rd Embodiment

Figure 26:
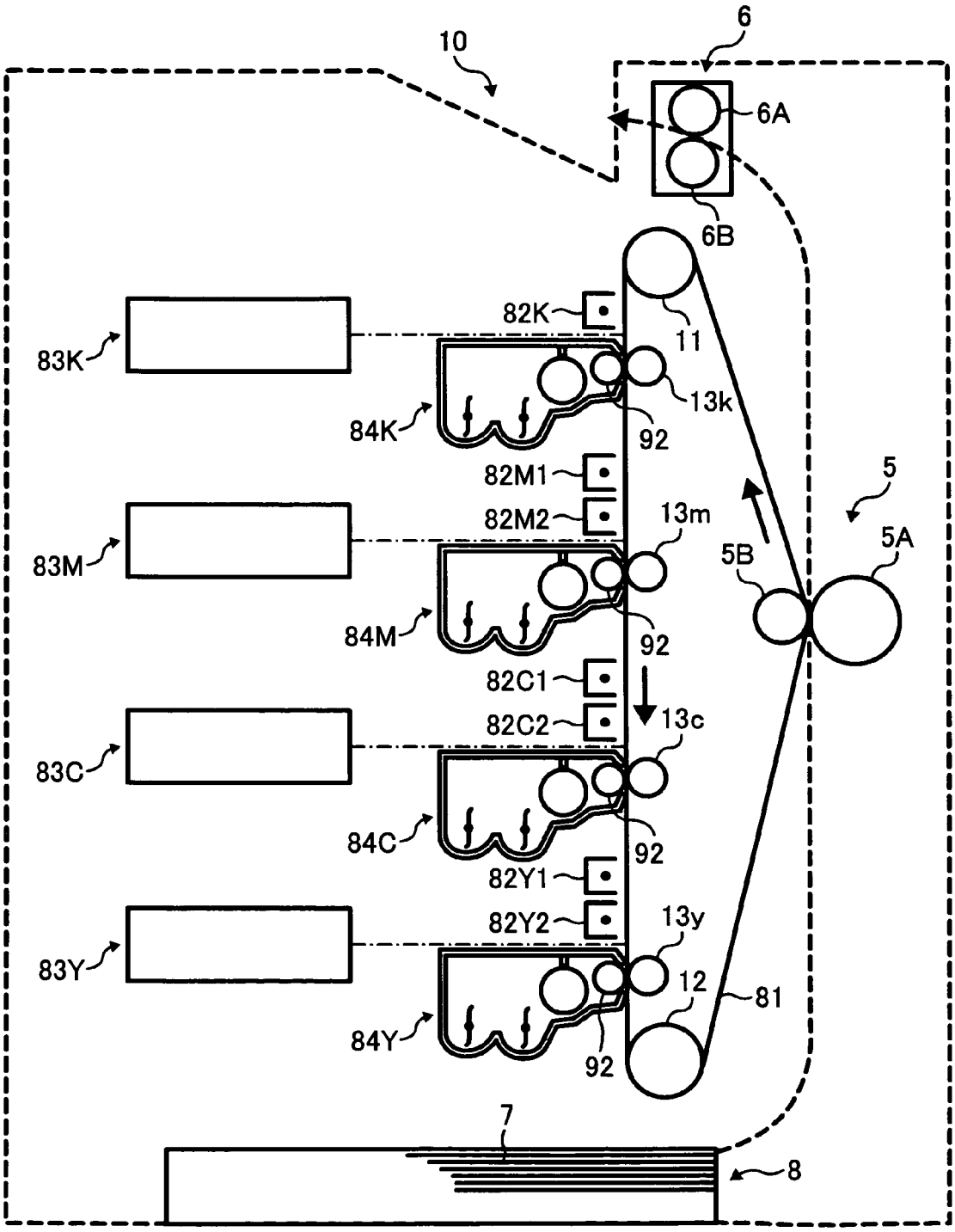
FIG. 26 is a diagram showing the approximate general composition of a third embodiment of an image forming apparatus according to the present invention.

Next, a third embodiment of the image forming apparatus relating to the present invention is described with reference to FIG. 26 and FIG. 27.

This image forming apparatus comprises: an image carrier 81 made of a belt-shaped photosensitive body; and, disposed in sequence from the upstream side to the downstream side following the circumferential direction of the image carrier 81 (the direction indicated by the arrow), a charging apparatus 82K which charges the image carrier 81 uniformly in order to form a black toner image on the belt-shaped image carrier 81; a writing apparatus 83K which forms a black latent image on the image carrier 81; a developing apparatus 84K which develops the latent image by depositing black toner on same; chargers 82M1 and 82M2 for charging or de-charging the image carrier 81 in order to form a magenta toner image; a writing apparatus 83M which forms a magenta latent image on the image carrier 81; a developing apparatus 84M which develops the latent image by depositing magenta toner on same; chargers 82C1 and 82C2 for charging or de-charging the image carrier 81 in order to form a cyan toner image; a writing apparatus 83C which forms a cyan latent image on the image carrier 81; a developing apparatus 84C which develops the latent image by depositing magenta toner on same; chargers 82Y1 and 82Y2 for charging or de-charging the image carrier 81 in order to form a yellow toner image; a writing apparatus 83Y which forms a yellow latent image on the image carrier 81; and a developing apparatus 84Y which develops the latent image by depositing yellow toner on same.

In other words, in this image forming apparatus, the first color for which an image is formed is black, and the image formation for the first toner is completed by charging, light exposure and development, similarly to normal image formation. In the case of the second and subsequent colors, two chargers 82 are provided respectively, for each color. The remainder of the composition is approximately the same as that of the second embodiment described above, and therefore, the corresponding reference numerals are used and further description thereof is omitted here.

Figure 27:
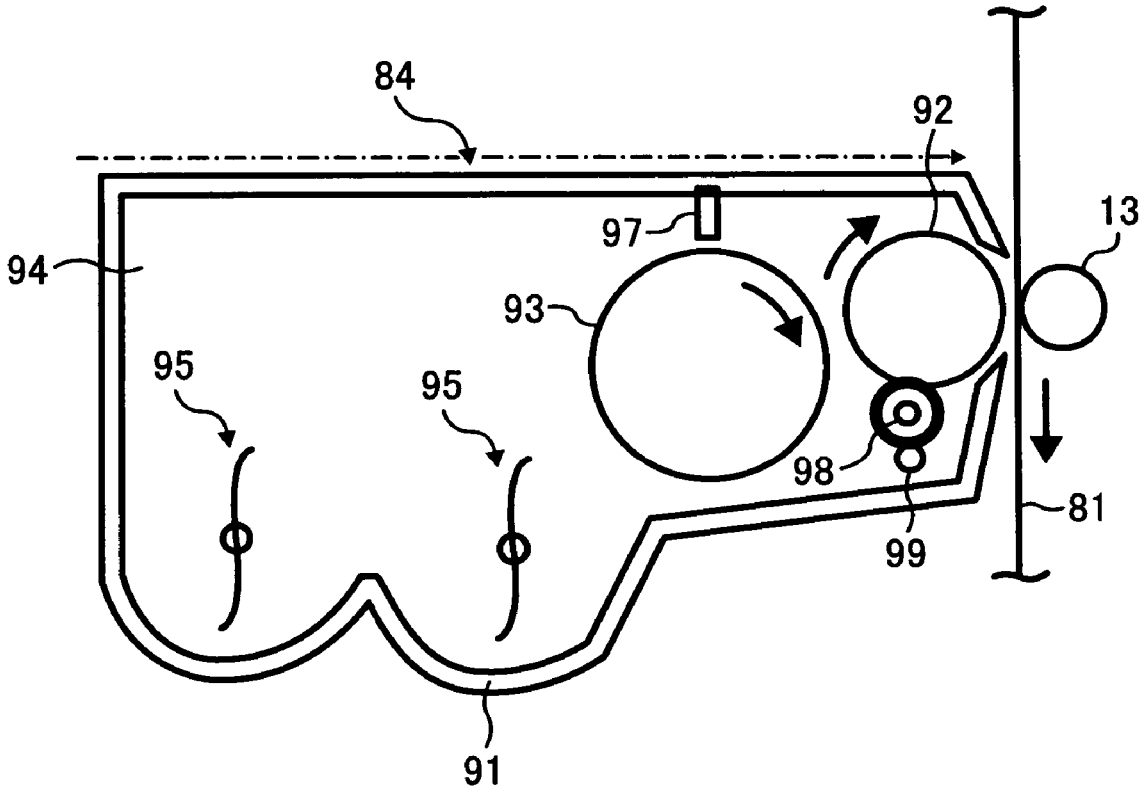
FIG. 27 is a diagram for describing a developing apparatus of the aforementioned image forming apparatus.

Moreover, as shown in FIG. 27, the developing apparatuses 84 each comprise, inside a casing 91: a toner conveyance member 92 formed in a roller shape which conveys toner to a region opposing the image carrier 81 (opposing region), by means of a phase-shift electric field; a developer carrier 93, which is a toner supply device for supplying toner to the toner conveyance member 92, provided facing this toner conveyance member 92; a developer accommodating unit 94 which accommodates a two-component developer consisting of the toner supplied by the developer carrier 93 and a magnetic carrier (it is also possible to use a one-component developer consisting of toner only); a churning screw 95; and a developer layer thickness restricting member 97.

Furthermore, the developing apparatuses 84 each have a brush roller 98 forming a rotating body which constitutes a recovery member having brushes with fine fibers on the outer circumferential surface thereof, disposed in the region between the developing region to the toner supply region of the toner conveyance member 92. The toner is made to adhere to the fibers of the brush, either by rotating the brush roller 98 at high speed to charge it by friction, or by applying a bias voltage of opposite polarity to that of the toner, and the toner is then removed mechanically. The bias voltage applied to the brush roller 98 is of opposite polarity to the bias voltage applied to the toner conveyance member 92.

Furthermore, a flicker bar 99 which makes contact with the front tips of the brush of the brush roller 98 is provided. The toner adhering to the tips of the fibers of the brush roller 98 is removed by colliding with the flicker bar 99, when the flicker bar 99 is made to come into contact with the brush tips by rotating the brush roller 98. Instead of the flicker bar 99, it is also possible to recover the toner electrostatically by causing a bias roller to make contact with the brush tips.

In this way, by providing a recovery member in the form of a rotating body which rotates while making contact with the electrostatic conveyance surface, it is possible readily to separate the toner dynamically from the electrostatic conveyance surface, and to recover that toner.

Next, the operation of this image forming apparatus is described with respect to the second color M (magenta), but the same description applies also to C (cyan) and Y (yellow).

The functions of the chargers 82M1 and 82M2 are to de-charge the potential of the toner layer before forming the image of the third color, and to create a uniform prescribed charge potential on the surface of the image carrier 1, including the existing toner layer. These functions can be realized either by charging or de-charging methods.

For example, in a method where the toner charge is removed by the charger 82M1 and the charge is adjusted to a prescribed charge potential by the charger 82M2, firstly, charge is removed from the toner layer, whereupon the whole of the image carrier is set to a prescribed charge potential. In this case, the bias voltages are set in such a manner that an AC bias offset with a suitable DC bias voltage is applied to the charger 82M1, and a DC bias is set for the charger 82M2, taking the potential of the non-image portions during image formation for the third color, as the grid potential.

Alternatively, it is also possible to remove the charge from the toner layer by means of the second charger 82M2, after adjusting the potential by means of the first charger 82M1. In this case, the charger 82M1 performs DC charging, taking the grid to be a potential of the same polarity, or opposite polarity, and higher absolute value than the potential of the non-image portions on the image carrier 1 before entering the two charge regions or the charging region of the charge removal device, while the charger 82M2 is supplied with an AC bias offset with a DC voltage having the charge potential as the image carrier when forming the image of the third color, and it removes charge from the toner layer, as well as completing charging for the next image formation step.

In either of these methods, in principle, it is possible to perform charging or de-charging by means of one charger device which applies an AC bias offset with a DC bias that create the prescribed potential on the image carrier required for image formation for the third color, but in order to reduce the current load on the charger, it is valuable to split these functions.

$4^{th}$ Embodiment

Figure 28:
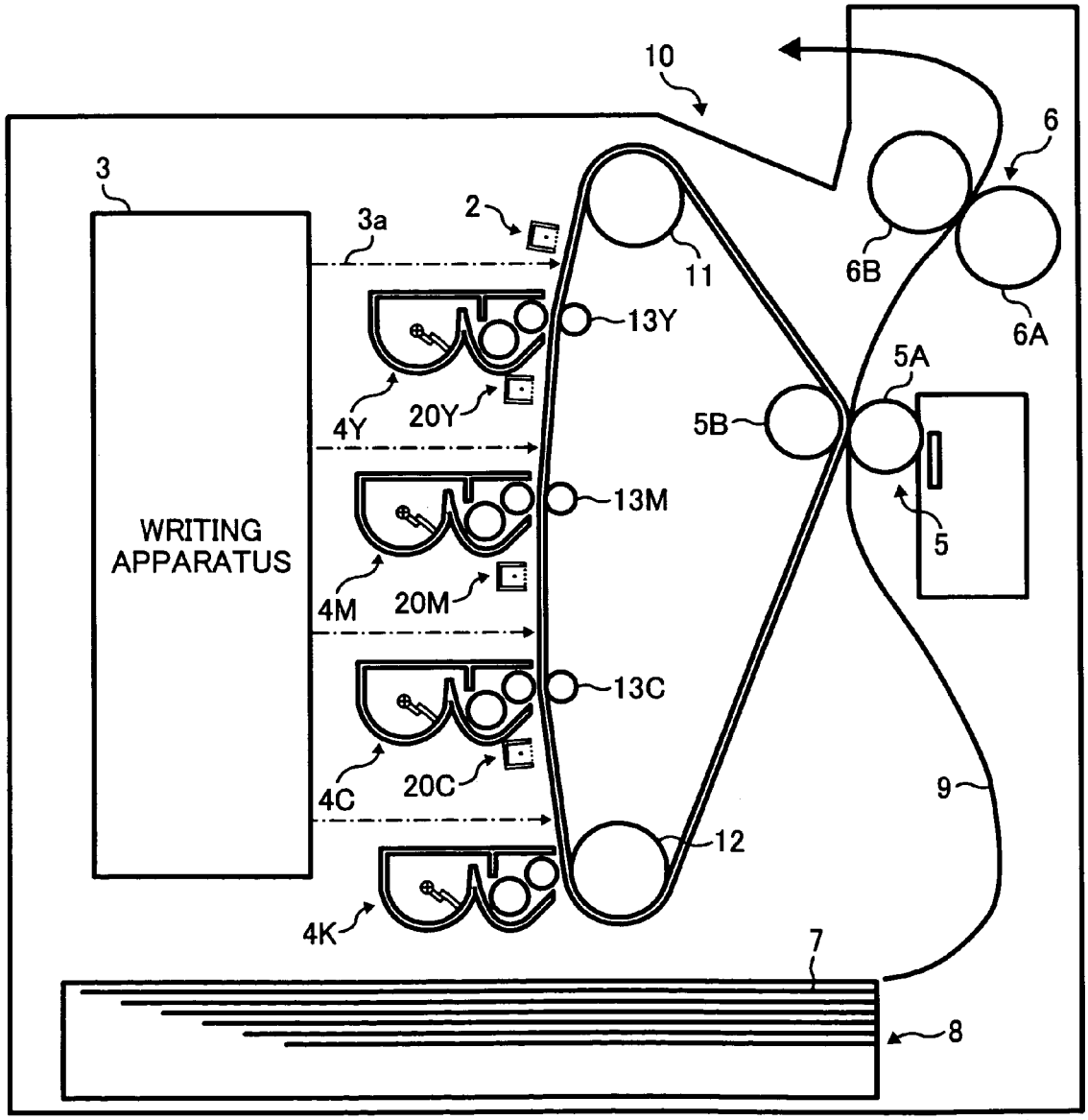
FIG. 28 is a diagram showing the approximate general composition of a fourth embodiment of an image forming apparatus according to the present invention.

Next, a fourth embodiment of the image forming apparatus according to the present invention is described with reference to FIG. 28.

This image forming apparatus has a composition in which the charging apparatuses 2M, 2C and 2K for the second and subsequent colors are omitted from the image forming apparatus of the second embodiment, and a charging apparatus 2 forming a single charging device is provided. In this image forming apparatus, as described previously, the charge removal voltage applied to the charge removal apparatus 20 by the voltage application device 201 is a voltage obtained by mutually superimposing a DC bias of the same polarity as the charging polarity of the image carrier 1, and an AC bias, and the potential on the image carrier 1 after charge removal is charged to the same polarity as the polarity with which the image carrier 1 is charged for image formation.

By adopting this composition, it is possible to perform the charging required for image formation, as well as removing charge, and hence the image formation processes can be simplified and the apparatus can be simplified.

In other words, charge removal is performed by applying a voltage obtained by mutually superimposing a DC bias of the same polarity as the polarity with which the image carrier is charged, and an AC bias, to the charging device which charges the image carrier, while seeking not to perform charging for image formation, after the charge removal, and consequently, it is possible to obtain satisfactory images by reducing the effects of the charge of preceding toner images, as well as being able to carry out the steps of charging and charge removal required for image formation by means of a single charge removal apparatus (or charging apparatus), thus making it possible to simplify the image formation process and the apparatus.

$5^{th}$ Embodiment

Next, a fifth embodiment of the image forming apparatus according to the present invention will be described. The composition of the image forming apparatus according to this embodiment is essentially the same as that of the image forming apparatus relating to the first embodiment and shown in FIG. 19, and therefore repeated description thereof is omitted here.

As described previously, the ET method is a development method which has high sensitivity with respect to the development potential difference, and therefore, it has been found that a new problem arises in that if there are regions of different potential on the image carrier, then the amount of toner deposited thereon is liable to vary. In other words, when seeking to develop an image using a toner of a particular color, if the toner layer already present on the image carrier has an electric potential, then the development of the next toner is liable to be affected by this potential.

Therefore, in the image forming apparatus according to this fifth embodiment, either one or both of the composition for removing charge from the image carrier on which a toner layer has been formed, as described in the second embodiment, and/or a composition for altering the light exposure energy, is adopted as a composition for reducing the effects of the toner layer already present on the image carrier.

Therefore, here, a composition which varies the light exposure energy in accordance with the presence or absence of a toner layer on the image carrier that is to be exposed, is described as a composition for reducing the effects of the toner layer already present on the image carrier.

Figure 29:
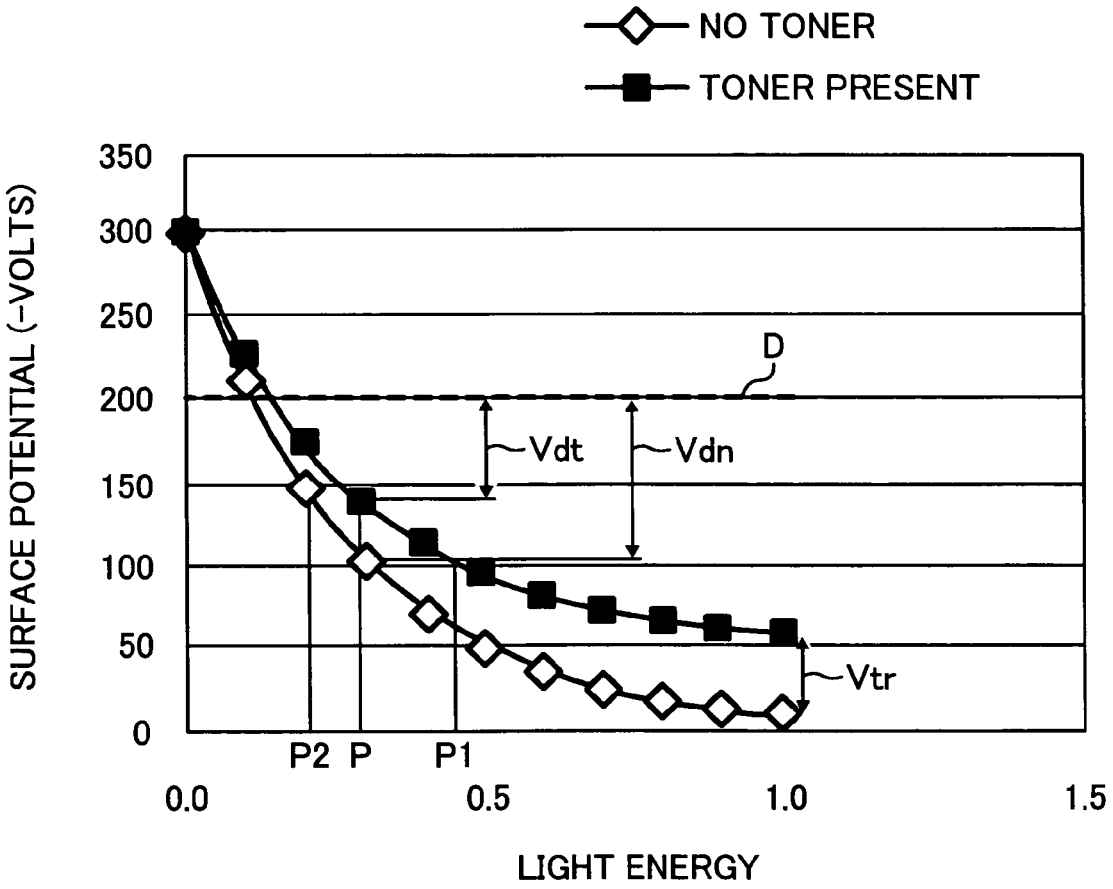
FIG. 29 is a diagram showing one example of change in the surface potential after light exposure, depending on the light exposure energy and the presence or absence of toner in a fifth embodiment of the present invention.

The potential of an image portion on a toner layer is now described with reference to FIG. 29, in relation to a case where the image portion that is to be developed lies in a region where toner has already been deposited onto the image carrier 1. FIG. 29 shows the surface potential after exposure with respect to the light exposure energy of the image carrier (photosensitive body), and it indicates the potential of the image portion (exposed portion) when a toner layer has been deposited on the photosensitive body and the photosensitive body is exposed to light via this toner layer ("toner present"), and the potential of the image portion when there is no toner layer ("no toner"). The results shown here are measurement results for a case where the amount of toner deposited in the toner layer is uniform, and the charge potential before light exposure is −300V.

As FIG. 29 reveals, the electric potential after exposure is reduced by the deposition of the toner layer. For example, if an image is written (exposed) with a laser of exposure energy P during image formation, then the image portions where there is no toner have a potential of −100V, whereas the image portions where there is toner have a potential of −140V. Here, if the average value of the conveyance bias is indicated by the broken line D, as the condition of the EH effect, then the developing potential difference in the portions where there is toner and the portions where there is no toner will be Vdt and Vdn. In EH development, the amount of toner deposited corresponds to the developing potential difference, and therefore, due to the differential |Vdt−Vdn|, a difference in density occurs in the image portions, depending on whether the image portion corresponds to a region where toner has already been deposited or a region where toner has not been deposited.

Therefore, in this image forming apparatus, the light exposure energy is altered in order to reduce this difference in density. For example, in FIG. 29, the light exposure energy is increased and set to a light exposure energy P1 in the regions where toner has already been deposited, thereby reducing the value of |Vdt−Vdn|, or alternatively, the light exposure energy is reduced and set to a light exposure energy P2 in the regions where toner has not been deposited, thereby reducing the value of the differential between the potential differences |Vdt−Vdn|.

In other words, if a latent image is formed on the image carrier, then taking Pt to be the light exposure energy when forming a latent image on a region where toner has already been deposited, and Pn to be the light exposure energy when forming a latent image on a region where toner has not been deposited, by establishing the relationship, $Pt=Pn\times\alpha$ (where $\alpha>1$), in other words, by ensuring that the light exposure energy Pt when forming a latent image on a region where toner has already been deposited is relatively larger than the light exposure energy Pn when forming a latent image on a region where toner has not been deposited, the potential of the image portions of the latent image formed on regions where there is toner will come close to the potential of the image portions of the latent image formed on region where there is no toner. Below, the coefficient "α" is called the exposure energy adjustment coefficient.

Figure 30:
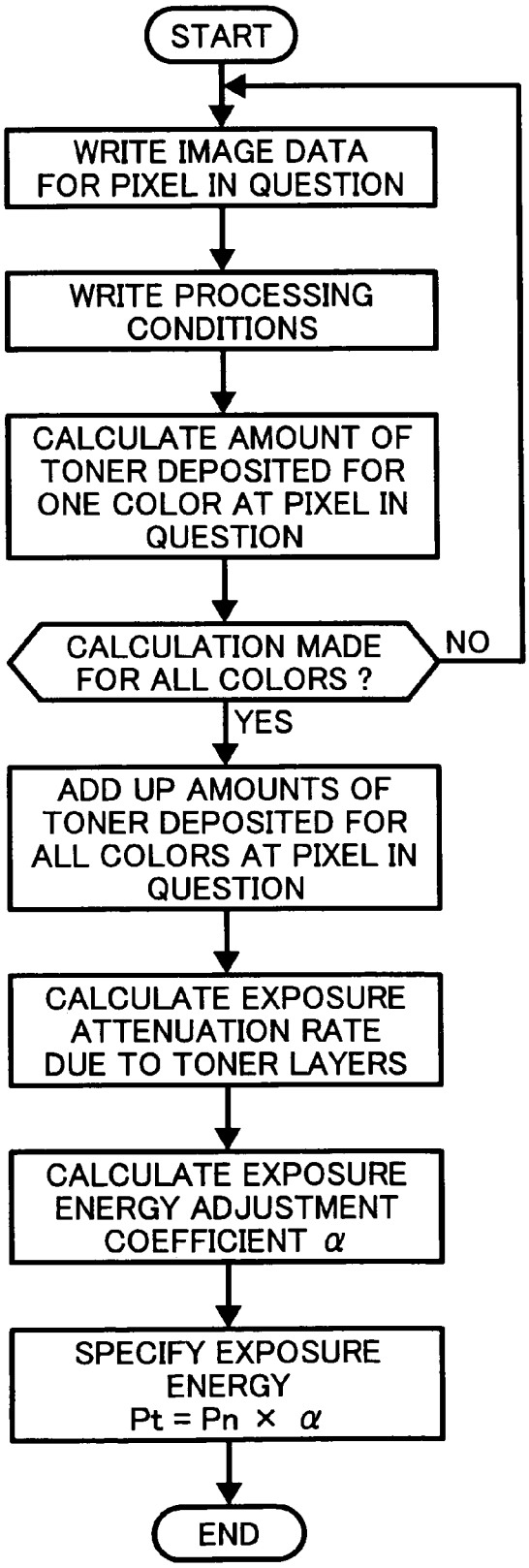
FIG. 30 is a flow diagram providing a description of a process for specifying the aforementioned exposure energy.

The processing for specifying the amount of exposure energy adjustment (change) is described here with reference to FIG. 30. This specification processing involves estimating a value corresponding to the amount of toner already deposited on the image carrier 1 when performing exposure to form a toner image of a particular color, in the image formation for a particular pixel, and then specifying the light exposure amount for forming a toner image of the color in question.

Here, the amount of toner of one color deposited on the pixel in question is calculated on the basis of data indicating the density of the pixel in question (any particular pixel), and the processing conditions during image formation for that color. This calculation is made for all of the colors, and the toner deposition amounts for the respective colors at the pixel in question are summed together, the rate of light attenuation caused by the toner layer is calculated from this sum value, and an exposure energy adjustment coefficient α is then calculated on the basis of this calculation result. The exposure energy Pt when forming a latent image on a region where toner has already been deposited is calculated using the adjustment coefficient α thus derived, by means of the equation, $Pt=Pn\times\alpha$ ($\alpha>1$).

The processing conditions indicate the average value of the bias applied to the electrodes 102 of the toner conveyance member 22 of the developing apparatus 4, for example. If the characteristics of the amount of toner deposited in relation to the image data can be guaranteed by process control, then it is possible to make a judgment on the basis of the image data alone.

Figure 31:
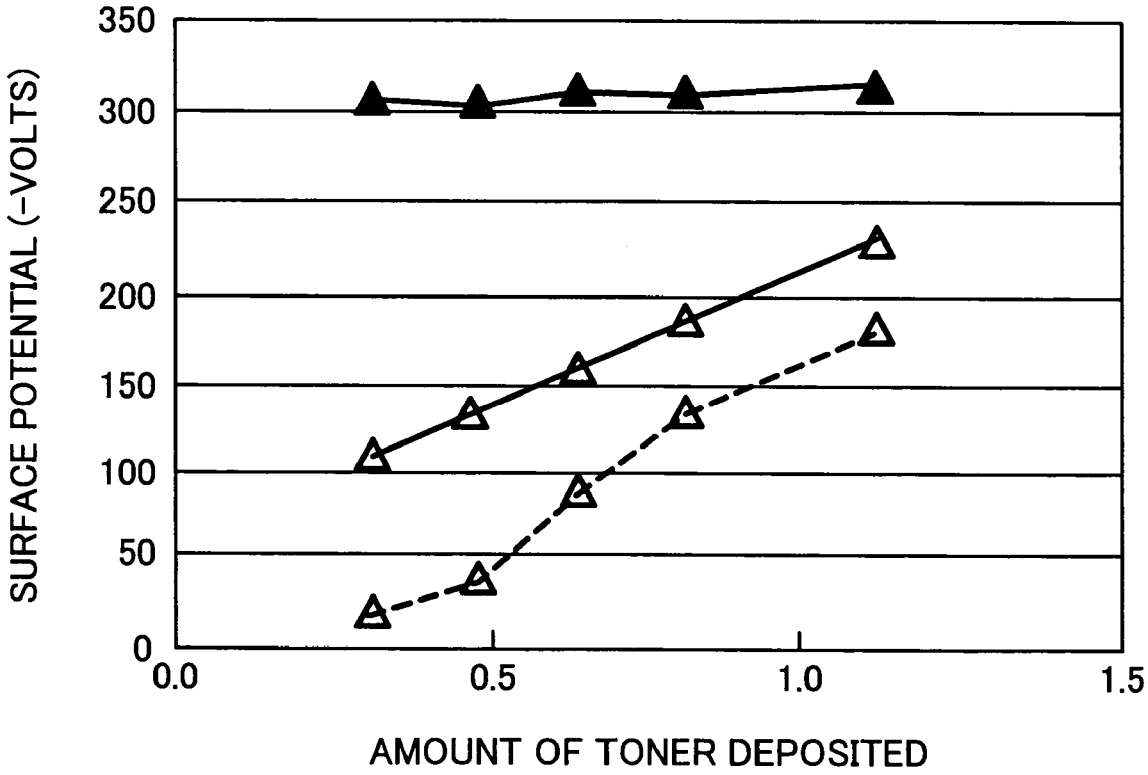
FIG. 31 is a diagram showing one example of the relationship between the amount of toner deposited, and the surface potential of image carrier.

Here, FIG. 31 shows an example of the relationship between the amount of toner deposited and the surface potential of the image carrier. In FIG. 31, the white triangular marks indicate the surface potential of the image carrier after exposure, and the solid triangular marks indicate the surface potential of the image carrier before exposure. The solid line and broken line joining the white triangular marks indicate the results for cases where the resulting toner deposition amount is different when an image is written at the same laser power. As shown in FIG. 20, the potential after exposure varies with the amount of toner deposited, and therefore, it is possible to estimate the amount of attenuation of the surface potential by referring to the values corresponding to the calculated amount of toner.

If toners of a plurality of colors have already been deposited on the image carrier when exposure is performed to form an image of a certain color, then by summing the respective light attenuation rates, it is possible to determine the overall exposure efficiency. In this case, the amount of attenuation of the surface potential of the image carrier, with respect to the amount of toner deposited, varies depending on the type of toner, the type of photosensitive body used as the image carrier, and the wavelength of the writing light, and the like, but if it can be estimated to be approximately uniform, then as described above, the amount of toner of each color can be calculated, the total amount of deposited toner can be found by summing together the amount of toner of each color, and the overall light attenuation rate due to the toner layers can be calculated readily on the basis of this total amount of deposited toner.

Figure 32:
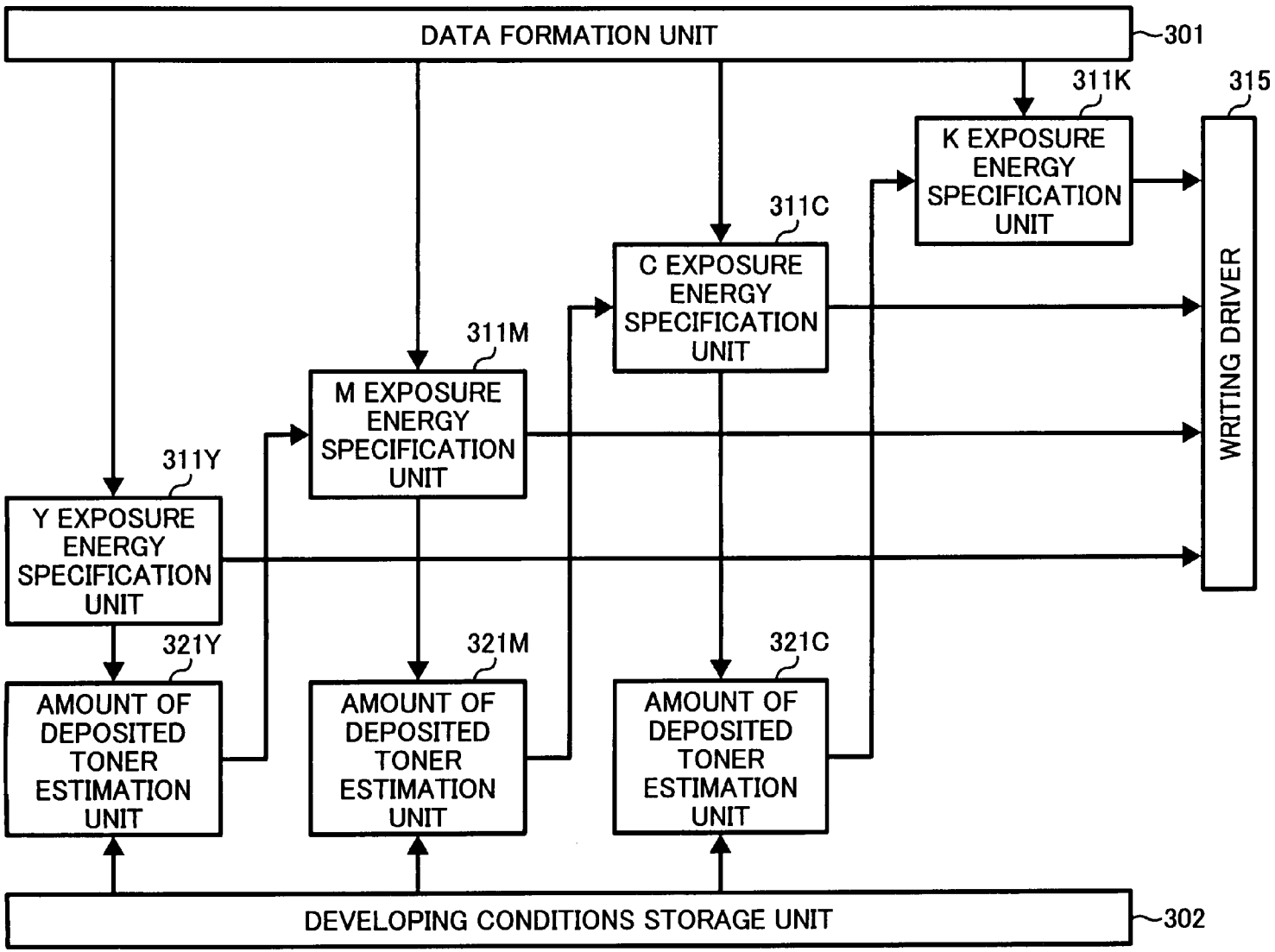
FIG. 32 is a diagram for describing a process for specifying the exposure energy.

A writing apparatus capable of changing the exposure energy is now described with reference to FIG. 32.

The writing apparatus 3 comprises: a data formation unit 301 which forms data indicates indicating the density of each pixel; a development conditions storage unit 302 which stores the development conditions; Y, M, C and K light exposure energy specification units 311Y, 311M, 311C and 311K, which specify the respective exposure energies for the first color (Y), second color (M), third color (C) and fourth color (K); an amount of deposited toner estimation unit 321Y which estimates the amount of Y toner deposited, on the basis of the development conditions from the development conditions storage unit 302 and the information from the Y exposure energy specification unit 311Y; an amount of deposited toner estimation unit 321M which similarly estimates the amount of M toner deposited; an amount of deposited toner estimation unit 321C which similarly estimates the amount of C toner deposited; and a writing driver 315 which drives an LD, or the like, to generate laser light at an exposure energy specified by one of the exposure energy specification units 311.

Here, the exposure energy specification units 311Y, 311M and 311C for the second and subsequent colors, M, C and K, specify an exposure energy for the corresponding color by calculating an exposure energy adjustment coefficient α, on the basis of the data formed by the data formation unit 301, and the amount of deposited toner estimated by the amount of deposited toner estimation units 321 of the preceding stages. The resulting exposure energy value is output to the writing driver 315.

Furthermore, the exposure energy of the laser in the writing apparatus 3 may be adjusted by power modulation which alters the actual emission intensity of the laser light, or it may be adjusted by pulse width modulation which changes the emission time of the laser light, for example. In either of these modulation methods, substantially the same relationship is established between the integral value of the energy irradiated per pixel and the surface potential of the image carrier. Although the signal level can be modulated through 256 different levels in each pixel, values in a range that is effective for modulating the exposure energy are previously specified and then used subsequently for modulation.

Pulse width modulation is used generally in multiple-value writing in which one pixel can be exposed at several different levels, and it uses a generic modulation circuit which is inexpensive to implement. On the other hand, power modulation adjusts the intensity of the power during writing, rather than adjusting the lighting time as in pulse width modulation, and it allows the exposure energy to be adjusted reliably at any point, regardless of the size of the pixel, the beam diameter, or other factors. Furthermore, it is also possible to combine use of pulse width modulation and power modulation.

As stated previously, by obtaining a value corresponding to the amount of deposited toner, on the basis of the image data for the toners already deposited on the image carrier and the image formation conditions during image formation (processing conditions), and by calculating an adjustment coefficient α from this value corresponding to the amount of deposited toner and changing the exposure energy accordingly, it is possible to adjust the exposure energy in a highly accurate fashion.

Besides this method, for example, it is also possible to distinguish simply on the basis of whether or not toner of the respective colors has been deposited, and to use the resulting number of colors as a value corresponding to the amount of deposited toner.

To give a concrete example, here light exposure for forming the final image for Y is described in a case where the color sequence of the toners deposited on the image carrier is the reverse of that in the aforementioned image forming apparatus, in other words, K, C, M and Y. When performing light exposure in order to form a Y image, there are seven possible scenarios relating to the previously deposited toner, namely:

cases where only one color out of BK, C and M has already been deposited on the image carrier at the corresponding pixel; cases where any two colors, namely, K and M, K and C, or C and M, have been deposited; and a case where all three colors have been deposited. The action of superimposing a fourth color on top of a position where three colors have already been deposited is not liable to occur, since algorithms, such as UCR, are used to restrict the amount of toner deposited in an actual image forming apparatus, but here, this case is treated as an exception.

Assuming that halftone processing of the image has been performed completely by surface area graduation, then the exposure energy can be adjusted readily by previously preparing values for the exposure energy adjustment coefficient $\alpha$ corresponding to the aforementioned seven scenarios (the number and type of colors of previously deposited toner).

Moreover, if there is no significant difference in the amount of deposited toner, between the respective colors, then it is possible to determine the exposure energy adjustment coefficient $\alpha$ on the basis of the number of colors of toner previously deposited on the pixel that is to be exposed, and consequently, the calculation of the exposure energy adjustment coefficient $\alpha$ is simplified and the exposure energy can be adjusted readily.

As shown in FIG. 31, the relationship between the exposure energy and the potential of the image portions on a toner layer in a case where exposure is performed through a toner layer indicates that even if the exposure energy is increased, the potential does not reach the level of the potential of the image portions on a photosensitive body on which no toner layer is present, and even if exposure is performed at a relatively high exposure energy, the potential of the image portions will be Vtr.

Therefore, it is necessary to adjust the exposure energy to the region prior to that where the potential of the image portions becomes Vtr. In order to further attenuate the potential Vtr of the image portion, it is useful to remove the charge from the toner layer, as described previously.

Next, a concrete experimental example of the fifth embodiment will be described.

Experimental Example 1

A color pattern such as that shown in FIG. 24 was output by using the image forming apparatus shown in FIG. 19. The pattern has six sections: Y (yellow), M (magenta), C (cyan), R (red), G (green) and B (blue), and the color sequence of the toners deposited onto the image carrier 1 is Y, M, C. R is equivalent to Y+M, G, to Y+C, and B, to M+C, and writing was carried out at the same light exposure energy in each of the monochrome color sections and the secondary color sections.

Figures 33, 34:
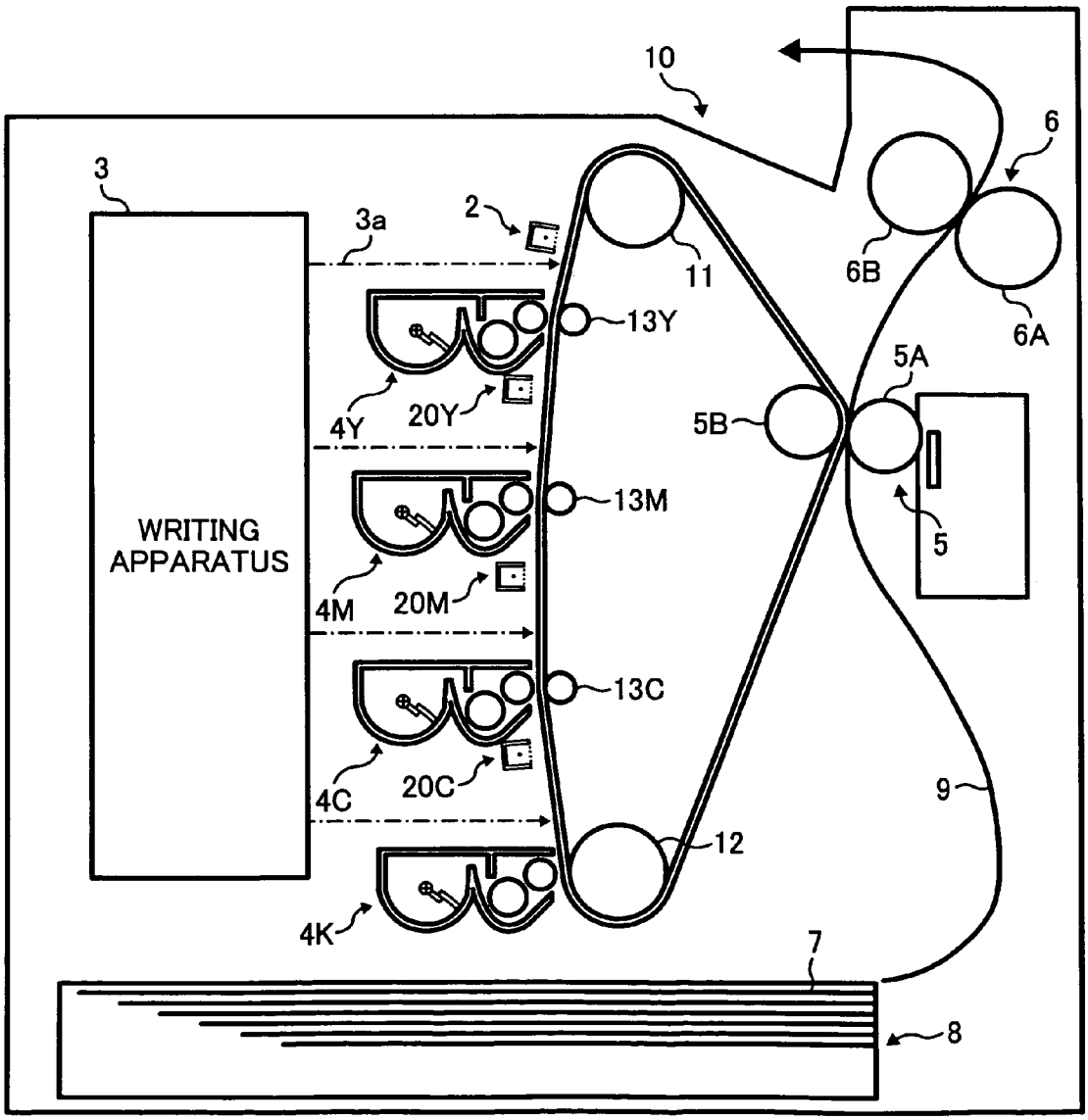
FIG. 33 is an illustrative diagram for describing experimental examples according to the fifth embodiment of the present invention.
FIG. 34 is a diagram showing the approximate general composition of a sixth embodiment of an image forming apparatus according to the present invention.

With regard to the experimental conditions, FIG. 33 shows the adjustment coefficients $\alpha 2$ and $\alpha 3$ obtained where the initial charging potential was −250V in all cases, the laser exposure energy for the first color was Pn, the exposure energies for the second color and third color were Pt2 and Pt3, and where $Pt2=Pn\times\alpha 2$ and $Pt3=Pn\times\alpha 3$.

As regards the results, under condition 1, the secondary colors were hardly reproduced at all, the R section was almost Y, the G section was yellow/green, the B section was a red/purple color, and it was observed that virtually no toner had been deposited on top of existing toner on the image carrier. Moreover, the K section had the same color hue that it had been sought to reproduce in the R section.

On the other hand, under condition 2, the exposure energy was adjusted, and it was possible to reproduce the 7 colors by intensifying the exposure energy when performing exposure onto existing toner. Furthermore, in the case of condition 3 where charge was removed from the toner layer by a charge removal device after forming the toner layers of the respective colors, it was possible to achieve suitable color reproduction by using lower values for the exposure energy adjustment value $\alpha 2$ and $\alpha 3$, compared to the case of condition 2 where charge removal was not performed.

Adjustment of the laser exposure energy can be achieved by using both power modulation which changes the actual emission intensity of the laser, and pulse width modulation which changes the emission time of the laser. Whichever of these methods was used, virtually the same relationship was established between the integral value of the energy irradiated per pixel and the surface potential of the photosensitive body. Although the signal level can be modulated through 256 different levels in each pixel, values in a range that is effective for modulating the exposure energy are previously specified and then used subsequently for modulation. Pulse width modulation is used generally in multiple-value writing in which one pixel can be exposed at several different levels, and it uses a generic modulation circuit which is inexpensive to implement. Power modulation adjusts the intensity of the power during writing, rather than adjusting the lighting time as in pulse width modulation, and it allows the exposure energy to be adjusted reliably at any point, regardless of the size of the pixel, the beam diameter, or other factors. Furthermore, it is also possible to combine use of pulse width modulation and power modulation.

In this way, in the present image forming apparatus, it is possible to form a color image by means of just one rotation of the image carrier 1, and since the toner images are mutually superimposed on the image carrier, then no intermediate transfer body is required. Therefore, it is possible to reduce the size of the apparatus, as well as preventing toner on the image carrier from being disturbed by downstream development steps, or recovered by a downstream developer, and hence satisfactory image can be obtained in a stable fashion, without color mixing. Moreover, by removing charge after development of each color, or by performing exposure at an adjusted exposure energy, there is no difference in density between portions where toner has been deposited previously and portions where toner has not been deposited previously, in the output image, and therefore, a uniform image is obtained and image quality is improved.

In other words, in the fifth embodiment, when forming an image by performing steps of charging, exposure and development for each color, on a single image carrier, and successively superimposing toner images of different colors during one rotation of the image carrier, since development is performed by applying a voltage having an average potential between the potential of the image portions of the latent image and the potential of the non-image portions to the electrodes of toner conveyance members which convey toner to a region opposing the image carrier by means of a conveyance electric field created by applying a multi-phase voltage to a plurality of electrodes aligned at a predetermined interval, then it is possible to form a color image by means of only one rotation of the image carrier 1, and since the toner images are mutually superimposed on the image carrier, then it is not necessary to provide an intermediate transfer body. Consequently, it is possible to reduce the size of the apparatus, as well as preventing the toner on the image carrier from being disturbed by downstream development steps, or recovered by downstream developing devices, and hence satisfactory images can be obtained in a stable fashion, without the occurrence of color mixing. Furthermore, by removing charge after development of each color, in the image of the third color, there is no difference in density between portions where magenta and/or yellow toner has been previously deposited and portions where toner has not been deposited, in the output image, and therefore, a uniform image is obtained and image quality is improved.

$6^{th}$ Embodiment

Next, a sixth embodiment of the image forming apparatus relating to the present invention is described with reference to FIG. 34.

In this image forming apparatus, the charging apparatuses of the second and subsequent colors, 2M, 2C and 2K, are omitted from the image forming apparatus according to the fifth embodiment, and a charging apparatus 2 forming a single charging device is provided. In this image forming apparatus, as described previously, the charge removal voltage applied to the charge removal apparatus 20 by the voltage application device 201 is a voltage obtained by mutually superimposing an AC bias with a DC bias of the same polarity as the charging polarity of the image carrier 1, and the potential on the image carrier 1 after charge removal is charged to the same polarity as the polarity with which the image carrier 1 is charged for image formation. In this image forming apparatus, a composition is also adopted for changing the exposure energy of the writing apparatus 3 as described above, and hence charge removal and exposure energy adjustment are used in combination.

By adopting this composition, it is possible to perform the charging required for image formation, as well as removing charge, and hence the image formation processes can be simplified and the apparatus can be simplified.

In other words, charge removal is performed by applying a voltage obtained by mutually superimposing a DC bias of the same polarity as the polarity with which the image carrier is charged, and an AC bias, to the charging device which charges the image carrier, while seeking not to perform charging for image formation after the charge removal, and consequently, satisfactory image can be obtained by reducing the effects of the charge of the preceding toner image, while also being able to carry out the steps of charging and charge removal required for image formation by means of a single charge removal apparatus (or charging apparatus), thus making it possible to simplify the image formation process and the apparatus.

The fifth and sixth embodiments described above related to an example where the average potential of the voltage applied by the voltage application device 104 to the electrodes 102 of the toner conveyance member 22 lies between the potential of the image portions and the potential of the non-image portions, but it is also possible to situate the potential at which the toner is repulsed and propelled from the toner conveyance member 22, in the pulse-shaped voltage applied by the voltage application device 104, at a value between the potential of the image portions and the potential of the non-image portions.

More specifically, as described above, it was confirmed by experimentation that, if a pulse-shaped voltage that changes between 20V and −80V is used as the voltage of the hopping voltage pattern shown in FIG. 11, and if the potential of the image portions is approximately 0V and the potential of the non-image portions is −110V, then the low-level potential in the pulse-shaped voltage (namely, the potential at which the negatively charged toner is repulsed and propelled) will be situated between the potential of the image portions of the latent image and the potential of the non-image portions, and hence, the toner will be directed toward the image carrier 1 in the image portions, whereas the toner will not be directed toward the image carrier 1 in the non-image portions, in this case also.

Consequently, even if a voltage comprising a pulse-shaped waveform is applied to the electrodes of the toner conveyance member, in which the potential at which the toner is repulsed and propelled in the pulse-shaped voltage is situated between the potential of the image portions of the latent image and the potential of the image portions, the toner will adhere to the image portions, while adherence of toner to the non-image portions is prevented, and therefore high-quality development can be achieved. Furthermore, by changing the exposure energy depending on whether or not toner has been deposited previously, as described in the previous embodiments, it is possible to form images with an even higher level of quality.

As described above, according to the present invention, when forming images by superimposing toner images of different colors, toner is made to adhere reliably to the image portions, while adherence of toner to the non-image portions is reduced, and hence satisfactory image which are free of image disturbance can be obtained. Furthermore, the image forming process is simplified, and the apparatus can be reduced in size.

Moreover, according to the present invention, when forming an image by superimposing toner images of different colors, it is possible to obtain a satisfactory multi-color image, even if the charge of previously developed toner is increased by the charging carried out prior to latent image writing in the development of the second and subsequence colors.

Various modifications will become possible for those skilled in the art after receiving the teachings of the present disclosure without departing from the scope thereof.

What is claimed is:

1. An image forming apparatus, which visualizes latent images formed successively on an image carrier and develops the latent images by depositing a plurality of toners of different colors on the image carrier, comprising:

a plurality of developing devices, each comprising a toner conveyance member that is cylindrically shaped and configured to convey said toner to a region opposing said image carrier by means of a conveyance electric field created by applying a multi-phase voltage to a plurality of electrodes arranged lengthwise in parallel at a predetermined interval along a length of the cylindrically shaped toner conveyance member; and a voltage application device configured to apply said voltage to the electrodes of said toner conveyance member of each of the developing devices, said voltage having an average potential value between a potential of image portions of said latent image and a potential of non-image portions of said latent image, wherein, taking Vm to be the average potential of the voltage applied to the electrodes of the toner conveyance member of the mth developing device (m=1~m) in the sequence of depositing toner on said image carrier, the relationship $|Vm|<|Vm+1|$ is established between the average potential values of the voltages applied to the electrodes of the toner conveyance members of the respective developing devices.

2. The image forming apparatus as claimed in claim 1, wherein said voltage application device applies a voltage comprising a pulse-shaped voltage superimposed with a DC bias, to the electrodes of the toner conveyance members.

3. The image forming apparatus as claimed in claim 2, wherein said voltage application device is able to change the voltage value of said DC bias.

4. The image forming apparatus as claimed in claim 2, wherein said voltage application device comprises a clamp circuit which clamps the voltage level, and this clamp circuit contains a device which generates said DC bias.

5. The image forming apparatus as claimed in claim 1, wherein said voltage application device applies a voltage comprising a pulse-shaped voltage superimposed with a DC bias, to the electrodes of the toner conveyance members, and taking Vdcm to be the potential of the DC bias in the voltage applied to the electrodes of the toner conveyance member of the mth developing device (m=1~m) in the sequence of depositing toner on the image carrier, then the relationship $|Vdcm|<|Vdcm+1|$ is established between the values of the potential Vdcm of the DC bias in the voltages applied to the electrodes of the toner conveyance members of the respective developing devices.

6. The image forming apparatus as claimed in claim 5, wherein said voltage application device is able to change the voltage value of said DC bias.

7. The image forming apparatus as claimed in claim 5, wherein said voltage application device comprises a clamp circuit which clamps the voltage level, and this clamp circuit contains a device which generates said DC bias.

8. The image forming apparatus as claimed in claim 1, wherein the differential between the potential of said image portions Vi and the potential of the non-image portions Vg is 300V or less.

9. The image forming apparatus as claimed in claim 1, wherein the maximum value of the electric field in the toner conveyance direction created when a voltage having a component which attracts toner and a voltage having a component which repulses the toner are applied to mutually adjacent electrodes in said toner conveyance device, is 2V/μm or above.

10. The image forming apparatus as claimed in claim 1, comprising a non-contact charging device which charges said image carrier without making contact with said image carrier.

11. The image forming apparatus as claimed in claim 1, comprising a non-contact charge removal device which removes charge from the toner on said image carrier, without making contact with said image carrier.

12. The image forming apparatus of claim 1, wherein said voltage application device is further configured to apply a voltage having an average potential value between the potential of image portions of said latent image, which has been reduced by the charge held by previously developed toner, and the potential of non-image portions of said latent image, to the electrodes of said toner conveyance member of each of the developing devices performing development of at least a second and subsequent colors.

13. The image forming apparatus of claim 12, wherein said voltage has an average potential value between the potential of image portions on said image carrier, in which the charge of previously developed toner has been increased by charging carried out prior to forming the latent image to be developed by the current developing device, and the potential of non-image portions on said image carrier.

14. The image forming apparatus of claim 12, wherein said voltage has an average potential value between the potential of image portions on said image carrier, which has been reduced by the charge held by the previously developed toner and the increase in the charge of the toner due to charging carried out prior to forming the latent image to be developed by the current developing device, and the potential of non-image portions on said image carrier.

15. An image forming apparatus, which visualizes latent images formed successively on an image carrier and develops the latent images by depositing a plurality of toners of different colors on said image carrier, comprising:

a plurality of developing devices, each comprising a toner conveyance member that it cylindrically shaped and configured to convey said toner to a region opposing said image carrier by means of a conveyance electric field created by applying a multi-phase voltage to a plurality of electrodes arranged lengthwise in parallel at a predetermined intervals along a length of the cylindrically shaped toner conveyance member; and a voltage application device configured to apply said voltage to the electrodes of the toner conveyance members of the respective developing devices, said voltage having a pulse-shaped waveform, in which a potential in the pulse-shaped waveform at which the toner is repulsed and propelled from said toner conveyance member lies between a potential of the image portions of the latent image on said image carrier and a potential of the non-image portions of said latent image, wherein said voltage application device is further configured to apply a voltage having a pulse-shaped waveform, in which the potential in the pulse-shaped waveform at which the toner is repulsed and propelled from said toner conveyance member lies between the potential of the image portions of the latent image on said image carrier, which has been reduced by a charge held by the previously developed toner, and the potential of the non-image portions of said latent image, to the electrodes of the toner conveyance member of each of the developing devices performing development of at least a second and subsequent colors.

16. The image forming apparatus as claimed in claim 15, wherein the differential between the potential of said image portions Vi and the potential of the non-image portions Vg is 300V or less.

17. The image forming apparatus as claimed in claim 15, wherein the maximum value of the electric field in the toner conveyance direction created when a voltage having a component which attracts toner and a voltage having a component which repulses the toner are applied to mutually adjacent electrodes in said toner conveyance device, is 2V/μm or above.

18. The image forming apparatus as claimed in claim 15, comprising a non-contact charging device which charges said image carrier without making contact with said image carrier.

19. The image forming apparatus as claimed in claim 15, comprising a non-contact charge removal device which removes charge from the toner on said image carrier, without making contact with said image carrier.

20. The image forming apparatus of claim 15, wherein said voltage has a pulse-shaped waveform, in which the potential in the pulse-shaped waveform at which the toner is repulsed and propelled from said toner conveyance member lies between the potential of the image portions on said image carrier, in which the charge of previously developed toner has been increased by charging carried out prior to forming the latent image to be developed by the current developing device, and the potential of non-image portions on said latent image.

21. The image forming apparatus of claim 15, wherein said voltage has a pulse-shaped waveform, in which the potential in the pulse-shaped waveform at which the toner is repulsed and propelled from said toner conveyance member lies between the potential of image portions on said image carrier, which has been reduced by the charge held by the previously developed toner and an increase in the charge of the toner due to charging carried out prior to forming the latent image to be developed by the current developing device, and the potential of non-image portions on said latent image.

22. An image forming apparatus, comprising:

one image carrier;

a plurality of developing devices configured to perform light exposure and develop successively formed latent images on said image carrier by depositing toners of different colors on same;

a plurality of charging devices configured to charge said image carrier for the different colors;

a plurality of toner conveyance members that are each cylindrically shaped and configured to convey said toner to a region opposing said image carrier by an electric field created by applying a multi-phase voltage to a plurality of electrodes arranged lengthwise in parallel at a predetermined interval along a length of each of the cylindrically shaped conveyance members; and a voltage application device configured to apply said voltage to the electrodes of said toner conveyance members of the developing devices, said voltage having an average potential value between the potential of the image portions of said latent image and the potential of the non-image portions of said latent image, wherein the light exposure intensity during light exposure onto said image carrier is set to a light intensity whereby the ratio V1/V0 is 0.9 or above, in which V0 is the potential of the latent image on the image carrier when light exposure for the first color is performed at a light exposure intensity of P, and V1 is the potential of the latent image on the image carrier when said light exposure is performed at a light exposure intensity of 0.8×P.

23. The image forming apparatus as claimed in claim 22, wherein the potential difference between the image portions of the latent image on said image carrier and the non-image portions of said latent image, is 300V or less.

24. An image forming apparatus, comprising:

one image carrier;

a plurality of developing devices configured to perform light exposure and develop successively formed latent images on said image carrier by depositing toners of different colors on same;

a plurality of charging devices configured to charge said image carrier for the different colors;

a plurality of toner conveyance members that are each cylindrically shaped and configured to convey said toner to a region opposing said image carrier by an electric field created by applying a multi-phase voltage to a plurality of electrodes arranged lengthwise in parallel at a predetermined interval along a length of each of the cylindrically shaped toner conveyance members;

a voltage application device configured to apply said voltage to the electrodes of said toner conveyance members of the developing devices, said voltage having a pulse-shaped waveform, in which the potential in the pulse-shaped waveform at which the toner is repulsed and propelled from said toner conveyance member lies between the potential of the image portions of the latent image on said image carrier and the potential of the non-image portions of said latent image; and charge removal devices configured to remove charge from said image carrier, disposed on the upstream side of the developing devices of the second and subsequent colors.

25. The image forming apparatus as claimed in claim 24, comprising a device for applying a DC bias to said charge removal devices.

26. The image forming apparatus as claimed in claim 24, comprising a device for applying a voltage comprising a mutually superimposed DC bias and AC bias, where the polarity of said DC bias is opposite to the polarity of the potential held by said image carrier before charge removal, to said charge removal devices.

27. The image forming apparatus as claimed in claim 24, comprising a device for applying a voltage comprising a mutually superimposed DC bias and AC bias, where the polarity of said DC bias is opposite to the polarity of the potential held by a toner image on said image carrier before charge removal, to said charge removal devices.

28. The image forming apparatus as claimed in claim 24, comprising a device for applying a voltage comprising a mutually superimposed DC bias and AC bias, where the polarity of said DC bias is the same as the polarity of the charging for image formation of the next color carried out after charge removal, to said charge removal devices.

29. The image forming apparatus as claimed in claim 24, wherein the light exposure intensity during light exposure onto said image carrier is set to a light intensity whereby the ratio V1/V0 is 0.9 or above, in which V0 is the potential of the latent image on the image carrier when light exposure for the first color is performed at a light exposure intensity of P, and V1 is the potential of the latent image on the image carrier when said light exposure is performed at a light exposure intensity of 0.8×P.

30. The image forming apparatus as claimed in claim 24, wherein the potential difference between the image portions of the latent image on said image carrier and the non-image portions of said latent image, is 300V or less.

31. An image forming apparatus, comprising:

one image carrier;

an exposure device configured to form a latent image by performing light exposure successively on the image carrier;

a plurality of developing devices configured to develop the latent images formed on said image carrier by depositing toners of different colors successively on same; and a plurality of toner conveyance members configured to convey said toner to a region opposing said image carrier by an electric field created by applying a multi-phase voltage to a plurality of electrodes arranged at a predetermined interval, wherein said voltage having an average potential between the potential of the image portions of said latent image and the potential of the non-image portions of same, is applied to said electrodes, and said exposure device includes a device configured to alter the light exposure energy during formation of said latent image in such a manner that, when forming a latent image on the image carrier on which toner has already been deposited, the value of |Vdt−Vdn| becomes small, where Vdt is the potential difference between said average potential and the potential of an image portion of said latent image on said image carrier in a region where toner has already been deposited, and Vdn is the potential difference between said average potential and the potential of an image portion of said latent image on said image carrier in a region where toner has not been deposited.

32. The image forming apparatus as claimed in claim 31, wherein the light exposure energy of said light exposure device when forming a latent image on a region where toner has already been deposited is relatively larger than the light exposure energy of same when forming a latent image on a region where toner has not been deposited.

33. The image forming apparatus as claimed in claim 32, wherein the light exposure energy when forming a latent image on a region where toner has already been deposited corresponds to a value equivalent to the amount of toner already deposited on the image carrier, for each pixel respectively.

34. The image forming apparatus as claimed in claim 33, wherein the value equivalent to the amount of toner already deposited on the image carrier is the number of colors of toner already deposited at that pixel.

35. The image forming apparatus as claimed in claim 33, wherein the value equivalent to the amount of toner already deposited on the image carrier is calculated on the basis of image data relating to the toner already deposited on the image carrier, and image formation conditions during image formation.

36. The image forming apparatus as claimed in claim 31, wherein said light exposure energy is altered by pulse width modulation.

37. The image forming apparatus as claimed in claim 31, wherein said light exposure energy is altered by power modulation.

38. The image forming apparatus as claimed in claim 31, comprising: a plurality of charging devices which charge said image carrier for each color; and charge removal devices which remove charge from said image carrier, disposed respectively on the upstream side of the developing devices of the second and subsequent colors.

39. The image forming apparatus as claimed in claim 31, wherein the potential difference between the image portions of the latent image on said image carrier and the non-image portions of same, is 300V or less.

* * * * *